US007294212B2

(12) United States Patent
Hirasawa et al.

(10) Patent No.: US 7,294,212 B2
(45) Date of Patent: Nov. 13, 2007

(54) HIGH-STRENGTH STAINLESS STEEL MATERIAL IN THE FORM OF A WHEEL RIM AND METHOD FOR MANUFACTURING THE SAME

(75) Inventors: Junichiro Hirasawa, Chiba (JP); Takumi Ujiro, Chiba (JP); Osamu Furukimi, Chiba (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/834,920

(22) Filed: Apr. 30, 2004

(65) Prior Publication Data

US 2004/0226634 A1 Nov. 18, 2004

(30) Foreign Application Priority Data

May 14, 2003 (JP) ..... 2003-135679
Nov. 19, 2003 (JP) ..... 2003-389822

(51) Int. Cl.
*C22C 38/44* (2006.01)
*C21D 8/00* (2006.01)

(52) U.S. Cl. ..... 148/325; 148/607; 148/608; 148/609; 148/610; 420/34; 420/67

(58) Field of Classification Search ..... 420/67, 420/64, 34; 301/95, 101; 148/325, 605–610
See application file for complete search history.

(56) References Cited

U.S. PATENT DOCUMENTS 5,178,693 A * 1/1993 Miyakusu et al. ..... 148/580
5,217,544 A * 6/1993 Baltenneck et al. ..... 148/325
6,786,981 B2 * 9/2004 Yazawa et al. ..... 148/325

FOREIGN PATENT DOCUMENTS

| | | | |
|---|---|---|---|
| EP | 0 273 973 A1 | | 3/1986 |
| EP | 0 273 279 A | | 12/1987 |
| EP | 0 384 317 | | 2/1990 |
| EP | 0 785 285 A1 | | 1/1997 |
| JP | 59 177324 A | | 10/1984 |
| JP | A 63-169331 | | 7/1988 |
| JP | A 63-169334 | | 7/1988 |
| JP | A 64-55363 | | 3/1989 |
| JP | A 1-172524 | | 7/1989 |
| JP | 2000-8144 | * | 1/2000 |

* cited by examiner

*Primary Examiner*—Deborah Yee
(74) *Attorney, Agent, or Firm*—Oliff & Berridge, PLC

(57) ABSTRACT

Material for stainless steel sheets is heated to a temperature within a range of 850 to 1250° C. and cooled at a rate 1° C./s or faster, the material including 0.02% by mass or less of C, 1.0% by mass or less of Si, 2.0% by mass or less of Mn, 0.04% by mass or less of P, 0.01% by mass or less of S, 0.1% by mass or less of Al, 11% by mass or more but less than 17% by mass of Cr, 0.5% by mass or more but, less than 3.0% by mass of Ni, and 0.02% by mass or less of N, so as to satisfy specific relationships between the compositions.

12 Claims, 5 Drawing Sheets

CROSS-SECTION ALONG LINE VB-VB

STATE BEFORE SEAM WELDING

HIGH-STRENGTH STAINLESS STEEL MATERIAL IN THE FORM OF A WHEEL RIM AND METHOD FOR MANUFACTURING THE SAME

BACKGROUND OF THE INVENTION

1. Field of Invention

The present invention relates to a high-strength stainless steel sheet, and particularly relates to a high-strength stainless steel sheet for civil engineering and construction structural materials.

2. Description of Related Art

Conventionally, as high-strength stainless steel sheets for structural materials of which corrosion resistance is required, cold-rolled austenitic stainless steel sheets, or martensitic stainless steel sheets, which have been tempered and annealed, have been widely used.

However, austenitic stainless steel sheets have a low Young's modulus, which is disadvantageous when it comes to ensuring rigidity in structural design. Also, austenitic stainless steel sheets may exhibit structural defects because of the strains introduced during cold rolling, and further, the costs of manufacturing austenitic stainless steel sheets are high because approximately 8% by mass of Ni, which is expensive, is used. Moreover, martensitic stainless steel sheets exhibit poor ductility, and markedly deteriorated workability.

On the other hand, ferritic stainless steel sheets have good ductility, but exhibit a low strength. Attempts have been made to improve the strength of ferritic stainless steel sheets by cold-rolling to increase strength, but this method reduces ductility because of the introduction of rolling strain, and there have been cases of fracturing at the time of forming.

An attempt has been made to deal with these problems by using a mixed structure of ferrite and martensite, thereby establishing both high strength and high ductility. For example, Japanese Examined Patent Application Publication No. 7-100822 (Japanese Unexamined Patent Application Publication No. 63-169334) discloses a method for manufacturing a high ductility and high strength chrome stainless steel strip with small in-plane anisotropy. In this method, a steel slab containing 10.0% to 14.0% of Cr, 3.0% or less of Ni, and 3.0% or less of Cu, and satisfying the following conditions:

$$C+N=0.01 \text{ to } 0.12\%$$

and $$Ni+(Mn+Cu)/3=0.5 \text{ to } 3.0$$

The steel slab is subjected to hot rolling, then cold rolling two or more times, with intermediate annealing therebetween and continuous finishing heat treatment, which consists in heating to a two-phase region temperature ($\alpha+\gamma$ region) of ferrite+austenite, which is the Ac1 point or higher but 1,100° C. or lower, and then cooling to 100° C. at a cooling rate of 1 to 500° C. per second.

Also, Japanese Examined Patent Application Publication No. 7-107178 (Japanese Unexamined Patent Application Publication No. 63-169331) discloses a method for manufacturing a high strength chrome stainless steel strip with superb ductility. In this method, a steel slab containing 10.0% to 20.0% of Cr, 4.0% or less of Ni, and 4.0% or less of Cu, and satisfying the following conditions:

$$C+N=0.01 \text{ to } 0.20\%$$

and $$Ni+(Mn+Cu)/3=0.5 \text{ to } 5.0$$

The stainless steel strip is subjected to hot rolling, cold rolling one time without intermediate annealing, and continuous finishing heat treatment, which consists in heating to a two-phase region temperature ($\alpha+\gamma$ region) of ferrite+austenite, which is the Ac1 point or higher but 1,100° C. or lower, and then cooling to 100° C. at a cooling rate of 1 to 500° C. per second.

Further, Japanese Examined Patent Application Publication No. 8-14004 (Japanese Unexamined Patent Application Publication No. 1-172524) discloses a method for manufacturing a high-strength chrome stainless steel strip with superb ductility. In this method, a steel slab containing 10.0% to 20.0% of Cr, 4.0% or less of Ni, and 4.0% or less of Cu and more than 1.0% but 2.5% or less of Mo, and satisfyg the following conditions:

$$C+N=0.010 \text{ to } 0.20\%$$

and $$Ni+(Mn+Cu)/3=5.0 \text{ or less}$$

The stainless steel strip is subjected to hot rolling, cold rolling and continuous finishing heat treatment, which consists in heating to a two-phase region temperature ($\alpha+\gamma$ region) of ferrite+austenite, which is the Ac1 point or higher but 1,100° C. or lower, and then cooling to 100° C. at a cooling rate of 1 to 500° C. per second.

Also, conventionally, ferritic stainless steel plates such as SUS430, SUS430LX, etc., having 16 to 18% of Cr have been used for steel sheets for bicycle rims, primarily because of their good corrosion resistance. Recently, the trend is for reduced weight in bicycles, and there is a demand for reduction in the thickness of bicycle rims, so there is a need to further improve the strength of SUS430, SUS430LX, etc. (450 to 550 MPa). Normally, bicycle rims are manufactured by bending a steel sheet, overlapping the widthwise center and the widthwise ends and seam welding, then cutting to a predetermined length, forming a ring shape, and performing flash butt welding at the abutted cut ends as shown in a cross-sectional diagram (FIG. 5A) taken along line VB-VB. Accordingly, strength, toughness, and corrosion resistance are required at the weld zones.

In light of such problems, a high-strength Cr-containing stainless steel used for bicycle wheel rims is proposed in, for example, Japanese Examined Patent Application Publication No.7-51737 (Japanese Unexamined Patent Application Publication No. 1-55363), wherein the chemical composition is adjusted to 11% to 17% of Cr, 0.8 to 3.0% of Ni, and 0.05 to 0.35% of Nb, 0.05 to 0.8% of Cu, and satisfying the following conditions:

$$C+N<0.05\%$$

$$Nb/(C+N)=2.5 \text{ to } 7$$

and a CRE value of 5 to 20.

This composition exhibits little material deterioration even after welding two or more times, and exhibits a proof stress of 60 kgf/mm$^2$ (588 MPa) or more in application to bicycle wheel rims.

However, while the steel sheets (steel strips) described in Japanese Examined Patent Application Publication No. 7-100822 (Japanese Unexamined Patent Application Publication No. 63-169334), Japanese Examined Patent Application Publication No.7-107178 (Japanese Unexamined Patent Application Publication No. 63-169331), and Japanese Examined Patent Application Publication No. 8-14004 (Japanese Unexamined Patent Application Publication No. 1-55363) exhibit sufficient workability in ductility and press forming, a problem remains in that sufficient bending properties are not obtained, which is an important feature in working structural materials. Moreover, the toughness of the welding zones is insufficient.

Also, while the steel sheets (steel strips) described in Japanese Examined Patent Application Publication No. 7-51737 (Japanese Unexamined Patent Application Publication No. 1-55363), Japanese Examined Patent Application Publication No. 7-100822 (Japanese Unexamined Patent Application Publication No. 63-169334), Japanese Examined Patent Application Publication No. 7-107178 (Japanese Unexamined Patent Application Publication No. 63-169331), and Japanese Examined Patent Application Publication No. 8-14004 (Japanese Unexamined Patent Application Publication No. 1-55363) each achieve a high enough strength to contribute to the reduction in the weight of bicycles. The process of manufacturing bicycle rims includes the essential process of punching holes for spokes through the seam weld zones as shown in FIG. 5A-5C, and rims manufactured using the steel sheets (steel strips) manufactured with the techniques described in these four documents generally exhibit cracking at the seam welding zones at the time of punching the spoke holes. Thus, the techniques described in these documents present problems regarding punching workability of the weld zones.

On the other hand, cold-rolling austenite stainless steels, such as SUS304, to increase strength of bicycle rims might be conceived, but it should be noted that austenite stainless steels have a low Young's modulus, is very disadvantageous regarding rim rigidity, and manufacturing costs are high due to the use of 8% by mass or more of expensive Ni.

SUMMARY OF THE INVENTION

Accordingly, it is an object of the present invention to solve the above-described problems, and provide a high-strength stainless steel sheet, with excellent bending workability and weld zone toughness, for civil engineering and construction structural materials which require corrosion resistance. The high-strength stainless steel, according to this invention, is also designed for vehicle-reinforcing weld structure materials such as pillars, beams, etc., suitably employed for bicycles, automotive vehicles, railway vehicles, and so forth, which require corrosion resistance. An object of the present invention is also to provided a method for manufacturing the stainless steel sheet.

It is another object of the present invention to provide a high-strength stainless steel sheet with superior corrosion resistance and workability regarding punching of welded zones, which would be, for instance, suitably employed for vehicular use, such as for bicycle wheel rims and so forth, for example, and also to provided a method for manufacturing the stainless steel sheet.

It should be noted that with regard to the present invention, the term "high-strength" stainless steel sheet refers to stainless steel sheets with tensile strength of about 730 to 1200 MPa. Tensile strength of 730 MPa exceeds the strength of conventional SUS430 and SUS430LX, and accordingly is sufficiently strong to allow for the reduction of the thickness of bicycle rims. Also, tensile strength exceeding 1200 MPa provides higher strength as a structure, but also provides an increase of the spring-back force, making bending at the time of forming the rim extremely difficult. A stainless steel sheet for bicycle rims preferably exhibits a tensile strength of about 800 MPa, and more preferably 900 to 1000 MPa.

To achieve these objects, according to a first aspect of the present invention, a high-strength stainless steel sheet comprises: a composition including 0.02% by mass or less of C, 1.0% by mass or less of Si, 2.0% by mass or less of Mn, 0.04% by mass or less of P, 0.01% by mass or less of S, 0.1% by mass or less of Al, 11% or more by mass but less than 17% by mass of Cr, 0.5% or more by mass but less than 3.0% by mass of Ni, and 0.02% by mass or less of N, so as to satisfy the following equations (1) through (4), $$12 \leqq Cr+Mo+1.5Si \leqq 17 \quad (1)$$

$$1 \leqq Ni+30(C+N)+0.5(Mn+Cu) \leqq 4 \quad (2)$$

$$Cr+0.5(Ni+Cu)+3.3Mo \geqq 16.0 \quad (3)$$

$$0.006 \leqq C+N \leqq 0.030 \quad (4)$$

wherein, the contents of C, N, Si, Mn, Cr, Mo, Ni and Cu are in % by mass, and the remainder of the alloy essentially consists of Fe and a structure including 12 to 95% by volume of martensite, and the remainder essentially consisting of ferrite.

The composition may further comprise one or both of 0.1% or more by mass but less than 2.0% by mass of Mo, and 0.1% or more by mass but less than 2.0% by mass of Cu. Also, the composition may further comprise 0.0005% to 0.0050% by mass of B.

Moreover, the composition may further comprise 0.5% or more by mass but less than 2.0% by mass of Mo and 0.0005% to 0.0050% by mass of B, with the range of C, Al, Cr, and N, being further restricted to 0.020% by mass or less of C, 0.10% by mass or less of Al, 11.0% or more by mass but less than 15.0% by mass of Cr, and 0.020% by mass or less of N, and with equations (1) through (4) being replaced by the following equations (5) through (8), $$14.0 \leqq Cr+Mo+1.5Si \leqq 15.0 \quad (5)$$

$$2.0 \leqq Ni+30(C+N)+0.5(Mn+Cu) \leqq 3.0 \quad (6)$$

$$Cr+0.5Ni+3.3Mo \geqq 16.0 \quad (7)$$

$$0.010 \leqq C+N \leqq 0.02 \quad (8)$$

wherein, the contents of C, N, Si, Mn, Cr, Mo, Ni and Cu are in % by mass, and wherein the structure includes 20% by volume or more of martensite, and the remainder essentially consisting of ferrite. Accordingly, the composition and the structure of the high-strength stainless steel sheet is designed for excellent corrosion resistance and punching workability of weld zones.

According to various exemplary embodiments, the composition may contain less than 0.04% by mass of Cu.

According to various exemplary embodiments, the high-strength stainless steel sheet may be for rim material to be used for bicycles, unicycles, carts using spoke wheels, tricycles, and wheelchairs.

According to various exemplary embodiments, the steel sheet may be a hot-rolled steel sheet, and the steel sheet may be a cold-rolled steel sheet.

According to a second aspect of the present invention, with a manufacturing method for a high-strength stainless steel sheet, the material for stainless steel sheets is subjected to finishing heat treatment by being heated to a temperature within the range of 850 to 1250° C., and then cooled at a cooling rate of 1° C./s or faster, the composition of the material includes: 0.02% by mass or less of C, 1.0% by mass or less of Si, 2.0% by mass or less of Mn, 0.04% by mass or less of P, 0.01% by mass or less of S, 0.1% by mass or less of Al, 11% or more by mass but less than 17% by mass of Cr, 0.5% or more by mass but less than 3.0% by mass of Ni, and 0.02% by mass or less of N, so as to satisfy the following equations (1) through (4).

$$12 \leqq Cr+Mo+1.5Si \leqq 17 \quad (1)$$

$$1 \leqq Ni+30(C+N)+0.5(Mn+Cu) \leqq 4 \quad (2)$$

$$Cr+0.5(Ni+Cu)+3.3Mo \geqq 16.0 \quad (3)$$

$$0.006 \leqq C+N \leqq 0.030 \quad (4)$$

wherein, the contents of C, N, Si, Mn, Cr, Mo, Ni and Cu are in % by mass.

The composition may further include one or both of 0.1% or more by mass but less than 2.0% by mass of Mo, and 0.1% or more by mass but less than 2.0% by mass of Cu. Also, the composition may further include 0.0005% to 0.0050% by mass of B.

Moreover, the composition may further include 0.5% or more by mass but less than 2.0% by mass of Mo and 0.0005% to 0.0050% by mass of B, with the range of C, Al, Cr, and N, being further restricted to 0.020% by mass or less of C, 0.10% by mass or less of Al, 11.0% or more by mass but less than 15.0% by mass of Cr, and 0.020% by mass or less of N, and with the equations (1) through (4) being replaced by the following equations (5) through (8), $$14.0 \leqq Cr+Mo+1.5Si \leqq 15.0 \quad (5)$$

$$2.0 \leqq Ni+30(C+N)+0.5(Mn+Cu) \leqq 3.0 \quad (6)$$

$$Cr+0.5Ni+3.3Mo \geqq 16.0 \quad (7)$$

$$0.010 \leqq C+N \leqq 0.02 \quad (8)$$

wherein, the contents of C, N, Si, Mn, Cr, Mo, Ni and Cu are in % by mass, wherein the material is subjected to a finishing heat treatment by being heated to a temperature within the range of 900 to 1200° C., and then cooled at a cooling rate of 5° C./s or faster, and wherein the composition of the high-strength stainless steel sheet is designed for excellent corrosion resistance and punching workability of weld zones.

According to various exemplary embodiments, the composition may contain less than 0.04% by mass of Cu.

According to various exemplary embodiments, the high-strength stainless steel sheet may be for rim material to be used for bicycles, unicycles, carts using spoke wheels, tricycles, and wheelchairs.

According to various exemplary embodiments, the steel sheet may be a hot-rolled steel sheet, and the steel sheet may be a cold-rolled steel sheet.

DETAILED DESCRIPTION OF PREFERRED EMBODIMENTS

The effects of various elements and structures on the strength, bending workability, and weld zone toughness of high-strength stainless steel sheets, have been studied, and as a result of this study, the following was found, according to various exemplary embodiments:

(1) Restricting the chrome equivalent (Cr+Mo+1.5Si) and the nickel equivalent (Ni+30 (C+N)+0.5 (Mn+Cu) to within a predetermined range allows the composition to be easily made into a martensite+ferrite mixed structure, and that high tensile strength of 730 MPa or higher can be obtained without loosing ductility.

(2) Bending workability markedly improves by adjusting the amount of C and N included so that the (C+N) amount is within an appropriate range.

(3) Weld zone toughness is markedly improved by reducing the amount of C and N contained and also including Ni.

Figure 1:
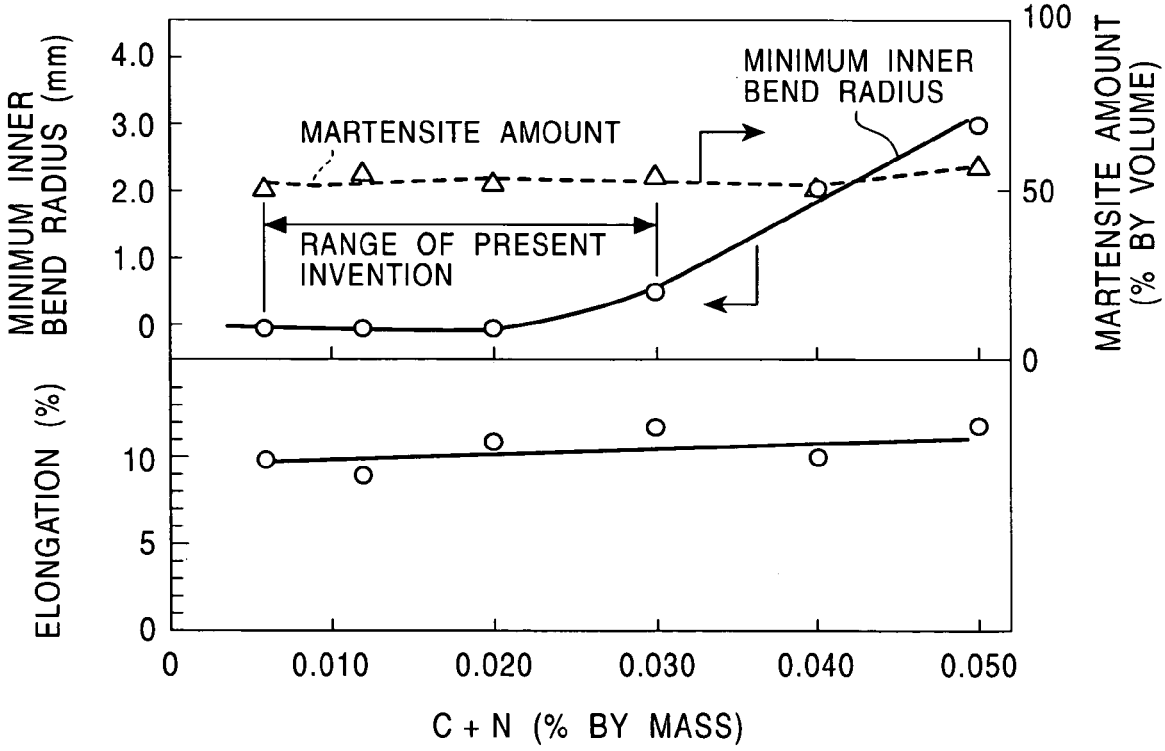
FIG. 1 is a graph illustrating the relation between bending workability, elongation, and the amount of (C+N)

FIG. 1 illustrates the relationship between (C+N) amount and bending workability, elongation, and martensite amount, with regard to a steel sheet (0.003 to 0.025% of C, 0.2% of Si, 0.2% of Mn, 0.02% of P, 0.003% of S, 0.003% of Al, 13% of Cr, 0.5% to 2.5% of Ni, and 0.003% to 0.025% of N, wherein the amounts of C, N, and Ni are adjusted such that the volume percentage of martensite is approximately 50%) air-cooled from a ferrite+austenite two-phase state ($\alpha+\gamma$ region) at 1000 to 1100° C., so as to yield a ferrite+martensite structure.

Bending workability was tested using a cold-rolled steel sheet 1.0 mm in thickness, which was bent 180°, and the minimum radius r (mm) where breaking did not occur was obtained. Also, a tensile test was performed on the same steel sheet to measure elongation, thereby evaluating ductility. As can be seen on FIG. 1, from the point where the amount of (C+N) exceeds 0.03%, bending workability markedly deteriorates, though there is hardly any change observed in ductility. Thus, it can be understood from FIG. 1 that the (C+N) amount greatly affects bending workability.

The effects of various elements and structures on the corrosion resistance and weld zone punching workability have also been studied, and as a result of this study, the following was found, according to various exemplary embodiments:

(4) Restricting the chromium equivalent (Cr+Mo+1.5Si) and the nickel equivalent (Ni+30 (C+N)+0.5 (Mn+Cu) to within an even narrower range than described above in (1), and also including appropriate amounts of Mo and B, markedly improves quenching and allows the composition to be easily made into a martensite+ferrite mixed structure, and that high tensile strength of 800 MPa or higher can be obtained without loosing ductility.

(5) Adjusting the amount of Cr, Ni, and Mo contained so that [Cr+0.5 Ni+3.3 Mo] reaches a predetermined value or greater markedly improves corrosion resistance of the parent material and punch hole shearing face.

(6) Setting the amount of Cr contained to less than 15% by mass and adjusting the amount of C and N contained so that (C+N) is within an appropriate range even narrower than described above in (3) markedly improves the punching workability of the weld zones.

First, the reason for restricting the composition of the high-strength stainless steel sheet, according to various exemplary embodiments of the present invention will be described. It should be noted that in the following, "% by mass" will be expressed simply by "%", i.e., that all percentages in the following are to be understood to be % by mass unless specifically stated otherwise.

Carbon: 0.02% or Less

According to various exemplary embodiments, carbon (C) is an element which increases the strength of the steel, and is preferably included at 0.005% or more in order to ensure the desired strength. However, including more than 0.020% markedly decreases ductility, bending workability, and weld zone toughness, and particularly deteriorates bending workability and punching workability of weld zones. Accordingly, carbon is restricted 0.02% or less with the present invention. It should be noted that carbon should be 0.02% or less, or more preferably 0.015% or less, from the perspective of bending workability and punching workability of weld zones. Even more preferable is 0.010% or less.

Also, for applications where corrosion resistance and punching workability of weld zones are required, such as usage for wheels like bicycle rims or the like, carbon should be 0.020% or less, or more preferably 0.015% or less, from the perspective of bending workability and punching workability of weld zones. Even more preferable is 0.010% or less.

Silicon: 1.0% or Less

According to various exemplary embodiments, silicon (Si) is an element which acts as an deoxidant, and also improves the strength of the steel. These effects are markedly recognized by including 0.05% Si or more. However, including more than 1.0% Si hardens the steel sheets and reduces toughness. Accordingly, silicon has to be restricted to 1.0% or less. More preferable is 0.3% or less, for increasing toughness.

Manganese: 2.0% or Less

According to various exemplary embodiments, manganese (Mn) is the element which generates austenite, and with the present invention, 0.1% or more is preferably included to generate 12 to 95% by volume of austenite at the time of the finishing heat treatment, at the ferrite+austenite two-phase temperature region ($\alpha+\gamma$ region) (approximately 850 to 1250° C.). However, including more than 2.0% Mn reduces the ductility and corrosion resistance of the steel sheet. Accordingly, manganese has to be restricted to 2.0% or less, and more preferably to 0.5% or less for ductility and corrosion resistance.

Phosphorous: 0.04% or less

According to various exemplary embodiments, phosphorous (P) is an element which reduces the ductility of the steel sheet, and is largely reduced in various exemplary embodiments of the present invention. However, large reduction of P requires a long time for dephosphorizing at the time of manufacturing the steel, which raises manufacturing costs. Accordingly, the upper limit for phosphorous in the present invention is 0.04%. For better ductility, 0.03% or less is preferable.

Sulfur: 0.01% or Less

According to various exemplary embodiments, sulfur (S) is an element which exists in the steel as an inclusion and generally reduces the corrosion resistance of the steel, and is preferably reduced as much as possible in the present invention. However, excessive reduction of S requires a long time for desulfurizing at the time of manufacturing the steel, which raises manufacturing costs. Accordingly, the upper limit for sulfur in the present invention is 0.01%. For better corrosion resistance, 0.005% or less is preferable.

Aluminum: 0.1% or Less

According to various exemplary embodiments, aluminum (Al) is an element which acts as a deoxidant and 0.01% or more is preferably included, but including more than 0.1% results in a significant generation of inclusions, and corrosion resistance and ductility deteriorate. Accordingly, in the present invention, aluminum is restricted to 0.1% or less. For better ductility, 0.05% or less is preferable.

Also, for applications where corrosion resistance and punching workability of weld zones are required, such as usage for wheels like bicycle rims or the like, aluminum should be 0.1% or less, more preferably is 0.10% or less, and even more preferably 0.05% or less.

Chromium: 11% or More but Less than 17%

According to various exemplary embodiments, chromium (Cr) is an element which effectively improves corrosion resistance, which is a feature of stainless steel, and 11% or more, preferably 11.0% or more of Cr need to be included to obtain sufficient corrosion resistance. On the other hand, excessive chromium may deteriorate the ductility and toughness of the steel sheet, so including 17% or more Cr markedly deteriorates the bending workability. Accordingly, in the present invention, chromium is restricted to 11% or more but less than 17%. Also, 15.0% or more chromium markedly deteriorates the punching workability of the weld zones, so less than 15.0% is preferable. Also, for better corrosion resistance, chromium included is preferably 12% or more, more preferably 13% or more, and for better punching workability of the weld zones, is preferably less than 14.0%. Moreover, for better bending workability, less than 15% is preferable, and more preferably less than 14%.

Also, for applications where corrosion resistance and punching workability of weld zones are required, such as use in wheels like bicycle rims or the like, chromium should be equal to or more than 11.0% but less than 15.0%. For better corrosion resistance, chromium included should be 12% or more, more preferably 13% or more, and for better punching workability of weld zones, less than 14.0%. Moreover, for better bending workability, less than 15% is preferable, and less than 14% is more preferable.

Nickel: 0.5% or More but Less than 3.0%

According to various exemplary embodiments, nickel (Ni) is an element which improves the corrosion resistance and toughness of weld zones, and generates. austenite. In the present invention, 12 to 95% by volume of austenite needs to be generated at the time of the finishing heat treatment, with the ferrite+austenite two-phase temperature region ($\alpha+\gamma$ region) (approximately 850 to 1250° C.), for high strength, and 0.5% or more nickel is preferably included to this end. On the other hand, including 3.0% or moremarkedly increases hardness, and ductility decreases. Accordingly, in the present invention, nickel is restricted to 0.5% or more but less than 3.0%. More preferable is a range of 1.8% or more but 2.5% or less. Nickel of 2.5% or less will yield sufficient corrosion resistance and improve weld zone toughening.

Nitrogen: 0.02% or Less

According to various exemplary embodiments, nitrogen (N) is an element which increases strength of the steel, as with carbon, but a large amount of nitrogen included markedly deteriorates ductility, weld zone toughness, and bending workability. Particularly, including more than 0.02% markedly deteriorates bending workability, and including more than 0.020% markedly deteriorates punching workability of the weld zones. Accordingly, in the present invention, nitrogen is restricted to 0.02% or less, and preferably to 0.020% or less. For better bending workability and punching workability of weld zones, 0.015% or less is preferable, more preferable is 0.012% or less, and even more preferable is 0.010% or less.

Also, for applications where corrosion resistance and punching workability of weld zones are required, such as use in wheels like bicycle rims or the like, nitrogen should be 0.020% or less. For better bending workability and punching workability of weld zones, 0.015% or less should be included. More preferable is 0.012% or less, and even more preferable is 0.010% or less.

In various exemplary embodiments of the present invention, in addition to the above-described basic composition, one or both of molybdenum and copper, and/or boron may be included.

One or Both of Molybdenum: 0.1% or More but Less than 2.0% and Copper:0.1% or More but Less than 2.0%

Both molybdenum and copper are elements which contribute to improved corrosion resistance, and particularly, molybdenum contributes to improved corrosion resistance of the punch hole shearing face of weld zones. In order to obtain such advantages, each of molybdenum and copper need to be included at 0.1% or more. Moreover, 0.5% or more molybdenum should be included to improve corrosion resistance of the punch hole shearing face of weld zones, but copper deteriorates the punching workability of the weld zones, and accordingly the amount of copper should be less than 0.04%. On the other hand, including 2.0% Cu or more saturates the above-described corrosion resistance advantages and workability deteriorates instead, so the advantages corresponding to the amount included cannot be obtained, which leads to economic losses. Accordingly, each of molybdenum and copper should be restricted to 0.1% or more but less than 2.0%. For better corrosion resistance, 1.0% or more of molybdenum and 1.0% or more of copper should be included.

Also, for applications where corrosion resistance and punching workability of weld zones are required, such as use in wheels like bicycle rims or the like, molybdenum is a crucial element, and 0.5% or more but less than 2.0% need to be included. On the other hand, including 2.0% or more molybdenum saturates the corrosion resistance advantages and workability deteriorates instead, so the advantages corresponding to the amount included cannot be obtained. Accordingly, molybdenum should be restricted to 0.1% or morebut less than 2.0%. On the other hand, copper deteriorates the punching workability of the weld zones, and accordingly should be less than 0.04%.

Boron: 0.0005 to 0.0050%

According to various exemplary embodiments, minute amounts of boron (3) act to increase the quenchability of the steel and increase strength, and also markedly improve the punching workability of the weld zones. Such advantages are observed by including 0.0005% B or more. However, including more than 0.0050% causes the corrosion resistance to deteriorate. Accordingly, boron is restricted to the range of 0.0005 to 0.0050%. For improving quenching, 0.0010% or more is preferably included, and for better corrosion resistance, 0.0030% or less is preferable.

Also, for applications where corrosion resistance and punching workability of weld zones are required, such as use in wheels like bicycle rims or the like, boron is a crucial element, and 0.0005 to 0.0050% need to be included. For improving quenching, 0.0010 or more is preferably included, and for better corrosion resistance, 0.0030% or less is preferable.

The composition of the stainless steel sheet according to various exemplary embodiments of the present invention satisfies the above-described ranges of component elements, and further includes the component elements so as to satisfy equations (1) through (4).

$$12 \leqq Cr+Mo+1.5Si \leqq 17 \quad (1)$$

$$1 \leqq Ni+30(C+N)+0.5(Mn+Cu) \leqq 4 \quad (2)$$

$$Cr+0.5(Ni+Cu)+3.3Mo \geqq 16.0 \quad (3)$$

$$0.006 \leqq C+N \leqq 0.030 \quad (4)$$

wherein, the contents of C, N, Si, Mn, Cr, Mo, Ni and Cu are in % by mass.

It should be noted that in calculating equations (1) through (4), Mo and Cu are calculated as being zero when "less than 0.1%" is included.

Further, for applications where corrosion resistance and punching workability of weld zones are required, such as use in wheels like bicycle rims or the like, the composition of the stainless steel sheet according to the present invention satisfies equations (5) through (8).

$$14.0 \leqq Cr+Mo+1.5Si \leqq 15.0 \quad (5)$$

$$2.0 \leqq Ni+30(C+N)+0.5(Mn+Cu) \leqq 3.0 \quad (6)$$

$$Cr+0.5Ni+3.3Mo \geqq 16.0 \quad (7)$$

$$0.010 \leqq C+N \leqq 0.02 \quad (8)$$

wherein, the contents of C, N, Si, Mn, Cr, Mo, Ni and Cu are in % by mass.

Accordingly, the reasons for the restrictions in each of the equations will be described.

$$12 \leqq Cr+Mo+1.5Si \leqq 17 \quad \text{Equation (1)}$$

$$1 \leqq Ni+30(C+N)+0.5(Mn+Cu) \leqq 4 \quad \text{Equation (2)}$$

$$14.0 \leqq Cr+Mo+1.5Si \leqq 15.0 \quad \text{Equation (5)}$$

$$2.0 \leqq Ni+30(C+N)+0.5(Mn+Cu) \leqq 3.0 \quad \text{Equation (6)}$$

In the present invention, the (Cr+Mo+1.5Si) in equation (1) (or in equation (5)) is defined as chromium equivalent, and the (Ni+30 (C+N)+0.5 (Mn+Cu)) in Equation (2) (or in Equation (6)) is defined as nickel equivalent.

Restricting the chromium equivalent and the nickel equivalent to that in equations (1) and (2), and heating to a high temperature (850 to 1250° C.) and then cooling, yields a mixed structure of ferrite which has excellent ductility and martensite which is very strong, so the stainless steel sheet has both excellent ductility and high strength.

On the other hand, if the chromium equivalent is lower than the above-described range (equation (1)), or if the nickel equivalent exceeds the above-described range (equation (2)), then the ratio of austenite at the time of heating to the high temperature becomes too high, and as a result the amount of martensite generated from austenite transformation while cooling becomes excessively large, and ductility deteriorates. Also, if the chromium equivalent exceeds the above-described range, (equation (1)), or if the nickel equivalent is below the above-described range (equation (2)), then the ratio of soft ferrite becomes excessively large, and the strength deteriorates.

Further, if the chromium equivalent is below the above-described range (equation (1)) and the nickel equivalent is below the above-described range (equation (2)), then the austenite is transformed to ferrite during cooling, and as a result hardenability deteriorates, the amount of martensite decreases and the strength drops. Moreover, if the chromium equivalent exceeds the above-described range (equation (1)) and the nickel equivalent exceeds the above-described range (equation (2)), then residual austenite which has lower strength is generated instead of martensite, and as a result high strength cannot be obtained. From the balance between strength and ductility, the chromium equivalent is preferably in a range of 14 to 15, and the nickel equivalent 2 to 3.

Further, for applications where corrosion resistance and punching workability of weld zones are required, such as use in wheels like bicycle rims or the like, the range of 14.0 to 15.0 for the chromium equivalent in equation (5), and the range of 2.0 to 3.0 for the nickel equivalent in equation (6), are preferable. It should be noted that in equation (6), Cu is calculated as being zero when "less than 0.1%" is included. Also, from the balance between strength and ductility, the chromium equivalent in equation (5) is preferably in the range 14.2 to 14.6, and the nickel equivalent in equation (6) in the range 2.2 to 2.8.

$$Cr+0.5(Ni+Cu)+3.3Mo \geqq 16.0 \quad \text{Equation (3)}$$

$$Cr+0.5Ni+3.3Mo \geqq 16.0 \quad \text{Equation (7)}$$

The left side of Equation (3) {Cr+0.5 (Ni+Cu)+3.3 Mo} (or Equation (7), however, Cu is an unavoidable inclusion and accordingly is not included in the Equations) is a factor relating to corrosion resistance, and with the present invention, the amounts of Cr, Ni, Cu, and Mo included are adjusted so that {Cr+0.5 (Ni+Cu)+3.3 Mo} is 16.0 or higher. This yields corrosion resistance equal to or greater than that of SUS430 or SUS430LX, and further, the corrosion resistance of the punch hole shearing face of weld zones is markedly improved. It should be noted that for better corrosion resistance, {Cr+0.5 (Ni+Cu)+3.3 Mo} is preferably 17.0 or higher. Also, for better corrosion resistance, {Cr+0.5 Ni+3.3 Mo} is preferably 17.0 or higher.

Also, for applications where corrosion resistance and punching workability of weld zones are required, such as use in wheels like bicycle rims or the like, for better corrosion resistance, the left side of equation (7) {Cr+0.5 Ni+3.3 Mo} is preferably 16.0 or higher, and even more preferably, 17.0 or higher.

$$0.006 \leqq C+N \leqq 0.030 \quad \text{Equation (4)}$$

$$0.010 \leqq C+N \leqq 0.02 \quad \text{Equation (8)}$$

The {C+N} in equation (4) (or equation (8)) is a factor affecting strength, bending workability, weld zone toughness, and punching workability of the weld zones. In the present invention, this is restricted to the range of 0.006 to 0.030. If {C+N} is less than 0.006, then the strength of the martensite structure is too low, so even if a ferrite+martensite mixed structure is formed, high tensile strength of 730 MPa or more cannot be realized. On the other hand, if {C+N} exceeds 0.030, then bending workability and weld zone toughness deteriorates markedly. It is thought that the reasons is that when the amount of C and N included is great, the difference in hardness between the soft ferrite and the hard martensite becomes extremely large, such that stress accumulates at the boundary thereof at the time of bending, and accordingly breakage occurs more easily. For higher strength, {C+N} should be 0.010% or more, and more preferably 0.012 or more. Also, for better bending workability, {C+N} should be 0.020 or less.

Moreover, if {C+N} exceeds 0.02, then weld zone punching workability markedly deteriorates. The reason that weld zone punching workability deteriorates, according to various exemplary embodiments, is that of the mixed structure of ferrite and martensite which is generated after welding, there is a great amount of C and N in solid solution in the martensite from transformation of the austenite which has great solid solubility of C and N, so the strength of the martensite increases, and the difference in strength with the soft ferrite becomes excessively large.

For better weld zone punching workability, {C+N} should be equal to or more than 0.010 but 0.02 or less, more preferably 0.020 or less, and even more preferably 0.017 or less.

Also, for applications where corrosion resistance and punching workability of weld zones are required, such as use in wheels like bicycle rims or the like, {C+N} in equation (8) should be equal to or more than 0.010 but 0.02 or less, more preferably 0.020 or less, and even more preferably 0.017 or less.

The stainless steel sheet, according to various exemplary embodiments of the present invention, is essentially formed of iron (Fe) in addition to the above-described components. The term "essentially formed of Fe" means that impurities other than Fe are still unavoidably included. Also, up to about 0.1% of Cu may be included by being mixed in from scrap iron which is part of the material, but applications where corrosion resistance and punching workability of weld zones are required, such as use in wheels like bicycle rims or the like, Cu as an unavoidable impurity is preferably kept to less than 0.04%. If Cu reaches 0.04% or more, the martensite excessively hardens in the same way as in the case where the {C+N} exceeds 0.02%, thereby deteriorating the weld zone punching workability. Examples of other unavoidable impurities besides Cu include small amounts (around 0.05%) of alkali metals, alkaline-earth metals, rar-earth elements, transition metals, and the like. Small amounts of such elements being included do not interfere with the advantages of the present invention in any way.

The structure restrictions of the high-strength stainless steel sheet according to the various exemplary embodiments of the present invention are described below. The high-strength stainless steel sheet, according to the present invention, has a mixed structure of martensite and remainder of ferrite, wherein the martensite is equal to or more than 12% by volume but equal to or less than 95%, preferably equal to or less than 85% and more preferably 20% or more but 80% or less. If the martensite is less than 12% by volume, ductility is excellent, but obtaining high strength with a tensile strength of 730 MPa or more becomes substantially difficult.

On the other hand, if martensite exceeds 95% by volume, strength of a tensile strength of 730 MPa or more can be obtained, but the ratio of ferrite, which has excellent ductility, is too low, so the steel sheet loses ductility, and binding workability deteriorates. For applications where corrosion resistance and punching workability of weld zones are required, such as use in wheels like bicycle rims or the like, martensite should be included at 20% by volume or more, preferably 50% or more, and while increased strength is desirable, 85% or more martensite by volume makes bending workability of forming rims and the like in particular markedly difficult.

A preferred manufacturing method of the high-strength stainless steel sheet according to the present invention is described below.

According to various exemplary embodiments, material for stainless steel sheets (hot-rolled steel sheets or cold-rolled steel sheets) is subjected to a finishing heat treatment which consists in being heated to a temperature within the range of 850 to 1250° C., preferably held at this temperature for 15 seconds or longer, and then cooled at a cooling rate of 1° C./s or faster, preferably 5° C./s or faster. The material comprises: the above-described component composition including 0.02% by mass or less of C, 1.0% by mass or less of Si, 2.0% by mass or less of Mn, 0.04% by mass or less of P, 0.01% by mass or less of S, 0.1% by mass or less of Al, 11% by mass or more but less than 17% by mass of Cr, 0.5% or more by mass but less than 3.0% by mass of Ni, and 0.02% by mass or less of N, so as to satisfy the following equations (1) through (4), $$12 \leqq Cr+Mo+1.5Si \leqq 17 \quad (1)$$

$$1 \leqq Ni+30(C+N)+0.\leqq(Mn+Cu) \leqq 4 \quad (2)$$

$$Cr+0.5(Ni+Cu)+3.3Mo \geqq 16.0 \quad (3)$$

$$0.006 \leqq C+N \leqq 0.030 \quad (4)$$

wherein, the contents of C, N, Si, Mn, Cr, Mo, Ni and Cu are in % by mass. The material may further comprise one or both of 0.1% or more by mass but less than 2.0% by mass of Mo, and 0.1% or more by mass but less than 2.0% by mass of Cu, and/or 0.0005% to 0.0050% by mass of B, with the remainder being Fe and unavoidable impurities.

The obtained hot-rolled steel sheet or cold-rolled steel sheet is preferably heated to a temperature in the range of 850 to 1250° C., which is the two-phase temperature region ($\alpha+\gamma$ region) of ferrite+austenite, as finishing heat treatment. According to various exemplary embodiments, the heat treatment atmosphere is not particularly restricted, and may be a reducing or oxidizing atmosphere. In the event that the heating temperature is lower than 850° C., sufficient recrystallization does not occur, and even in the event that the heating temperature exceeds the Ac1 transformation point, the transformation speed from ferrite to austenite is slow, and there may be cases where sufficient martensite cannot be obtained following cooling.

Also, in the event that the heating temperature exceeds 1250° C., the ratio of δ-ferrite increases, so the ratio of austenite is insufficient, and the 12% or more by volume of martensite generated by transformation from austenite during cooling cannot be ensured. Note that the two-phase structure of ferrite+austenite is stably obtained in the temperature range of 900 to 1200° C., and accordingly is preferably heated to this temperature range. Also, heating to 950° C. or higher is preferable in order to obtain a uniform structure with sufficient recrystallization.

Also, the hot-rolled steel sheet or cold-rolled steel sheet is preferably maintained at the above heating temperature for 15 seconds or longer. If the holding time is less than 15 seconds, recrystallization may be insufficient, and transformation from ferrite to austenite is also insufficient, so the desired ferrite+austenite two-phase structure cannot be obtained, and sufficient strength cannot be achieved. It should be noted that from the perspective of productivity of finishing heat treatment, the heating time is preferably 180 seconds or less.

According to various exemplary embodiments, this hot-rolled steel sheet or cold-rolled steel sheet is cooled to the Ms point (the temperature at which the austenite begins transformation to martensite during cooling) or lower, preferably 200° C. or lower, as the cooling-stop temperature, at a cooling rate of 1° C./s or faster, and preferably 5° C./s or faster. After reaching the cooling-stop temperature, the cooling may continue at that rate down to room temperature, but there is no particular need for temperature control here, and accordingly the sheet may be left to cool to room temperature. At a slow rate where the average cooling rate from the heating temperature to the cooling-stop temperature (average cooling rate) is slower than 1° C./s, part of the austenite is transformed into ferrite during cooling so the amount of ferrite increases, and the 12% by volume or more of martensite generated by transformation from austenite during cooling cannot be ensured, and consequently, the goal of high strength cannot be achieved. In order to ensure stable strength, a cooling rate of 5° C./s or faster is preferable. While there is no particular upper limit set for the cooling rate from the heating temperature, generally 100° C./s or slower is preferable. It should be noted however, that excessively fast cooling may result in cooling irregularities, and unevenness on the steel sheet.

For applications where corrosion, resistance and punching workability of weld zones are required, such as use in wheels like bicycle rims or the like, the material for stainless steel sheets (hot-rolled steel sheets or cold-rolled steel sheets) further includes 0.5% or more by mass but less than 2.0% by mass of Mo and 0.0005% to 0.0050% by mass of B, with the range of C, Al, Cr, and N, being further restricted to 0.020% by mass or less of C, 0.10% by mass or less of Al, 11.0% by mass or more but less than 15.0% by mass of Cr, and 0.020% by mass or less of N, and with equations (1) through (4) being replaced by the following equations (5) through (8), $$14.0 \leqq Cr+Mo+1.5Si \leqq 15.0 \quad (5)$$

$$2.0 \leqq Ni+30(C+N)+0.5(Mn+Cu) \leqq 3.0 \quad (6)$$

$$Cr+0.5Ni+3.3Mo \leqq 16.0 \quad (7)$$

$$0.010 \leqq C+N \leqq 0.02 \quad (8)$$

wherein, the contents of C, N, Si, Mn, Cr, Mo, Ni and Cu are in % by mass. The material further includes 0.04% or less of Cu as an unavoidable impurity, wherein the material is subjected to finishing heat treatment and is heated to a temperature within the range of 900 to 1200° C., preferably held at this temperature for 15 seconds or longer, and then cooled at a cooling rate of 5° C./s or faster.

The reason why the finishing heat treatment temperature is set to 900 to 1200° C. is that if the heating temperature is lower than 900° C., even if the heating temperature exceeds the Ac1 transformation point, then the transformation speed from ferrite to austenite is slow, and the 20% by volume or more of martensite generated by transformation from austenite during cooling cannot be obtained. Also, if the heating temperature exceeds 1200° C., then the ratio of δ-ferrite increases, so the ratio of austenite becomes insufficient, and the 20% by volume or more of martensite generated by transformation from austenite during cooling cannot be achieved. Also, heating to 950° C. or higher is preferable in order to obtain 50% by volume or more of martensite.

The reason why the cooling rate is set to 5° C./s or faster is that, at a slow rate where the average cooling rate from the heating temperature to the cooling-stop temperature (average cooling rate) is slower than 5° C./s, the amount of the austenite transformed into ferrite during cooling increases, and the 20% by volume or more of martensite generated from the transformation of austenite during cooling cannot be achieved and consequently the goal of high strength cannot be achieved. While there is no particular upper limit set for the cooling rate, generally 100° C./s or slower is preferable.

According to various exemplary embodiments, the hot-rolled steel sheet or cold-rolled steel sheet is preferably subjected to acid wash. The finishing heat treatment is normally performed in a continuous annealing furnace for coils, and a batch annealing furnace for cutlength sheets.

According to various exemplary embodiments, the hot-rolled steel sheet or cold-rolled steel sheet manufactured this way is subjected to bending working and the like according to the application thereof, and is formed into pipes, panels, and the like. The articles thus formed are then used as, for example, vehicle-reinforcing weld structure materials such as pillars, bands, beams, and the like, for railway vehicles, bicycles, automobiles, busses, bicycle rims, and the like. The welding method for this structural members is not particularly restricted. General arc welding methods such as MIG (metal-arc inert gas welding), MAG (metal-arc active gas welding), and TIG (gas tungsten arc welding), spot welding, seam welding and other resistance welding methods, high-frequency resistance welding such as seam welding, and high-frequency induction can be performed.

According to various exemplary embodiments, the processes up to before the finishing heat treatment process may be conventional processes, and there is no particular restriction on these processes other than preparing the components for the composition of the molten steel at the time of melting the steel. Methods generally employed for manufacturing martensitic stainless steel sheets can be applied here without change. Preferred processes up to before the finishing heat treatment are as follows.

For example, a steel converter or electric furnace or the like is used so as to meet the scope of the present invention, and secondary refining is performed by VOD (Vacuum Oxygen Decarburization) or AOD (Argon Oxygen Decarburization) so as to produce the steel. The produced steel can be formed into slabs with known casting methods. From the perspective of productivity and quality, continuous casting is preferably applied for slabs. A steel slab obtained by continuous casting is heated to 1000 to 1250° C., subjected to ordinary heat rolling conditions, such as being formed into sheet bars 20 to 40 mm in thickness by reverse milling, and then formed into hot-rolled steel sheets 1.5 to 8.0 mm in thickness as desired by a tandem mill. Alternatively, hot-rolled steel sheets 1.5 to 8.0 mm in thickness as desired may be formed with the reverse mill alone. The hot-rolled steel sheet is subjected to batch annealing at preferably 600 to 900° C. as necessary, and descaled by acid wash or the like. Also, depending on the application thereof, the hot-rolled sheet is annealed and acid-washed, then subjected to cold-rolling to form cold-rolled steel sheets 0.3 to 3.0 mm in thickness. If necessary, the cold-rolled steel sheets are subjected to continuous or batch annealing at 650° C. to 850° C., and acid washing. For better productivity, the finishing heat treatment according to the present invention is preferably carried out for the hot-rolled or cold-rolled steel, without annealing or acid wash.

The present invention is described in further detail, according to the exemplary embodiments below:

EXAMPLES

Example 1

With the hot-rolled stainless steel sheets of the composition shown in Table 1 or Table 2 as material, finishing heat treatment processing is performed by a batch annealing furnace of the conditions shown in Table 3 or Table 4, and then washed with acid. The obtained steel sheet 3 mm in thickness is subjected to (1) metal structure observation, (2) tensile testing, (3) corrosion testing, (4) bending testing, and (5) weld-heat-affected zone toughness testing. The testing is as follows. Note that the hot-rolled steel sheet which is the material was made by heating a 100 kgf ingot of steel of molten in a high-frequency furnace to 1200° C., and finished by hot-rolling to a thickness of 3 mm by a reverse mill.

(1) Metal Structure Observation

A specimen (size: t (same thickness)×10 mm×10 mm) for metal structure observation is taken from the obtained steel sheet, a cross-sectional cut face parallel to the rolling direction is corroded with Murakami reagent (alkali solution of red prussiate (10 g of red prussiate, 10 g of caustic potash, and 100 cc of water)), the micro-structure is observed using an optical microscope at 1000 times, five fields are taken of each, the structure is identified and further the area percentage of the martensite is obtained using an image analyzing device, with the average of the five fields as the volume percentage of the martensite structure.

(2) Tensile Test

Five JIS No. 13 B tensile test specimens are taken from the obtained steel sheet so that the tensile direction matches the rolling direction, tensile testing is executed conforming to the stipulations of JIS Z 2241, so as to obtain the tensile strength (TS) and elongation (El), which were averaged.

(3) Corrosion Test

Two corrosion specimens (size: t×70 mm×150 mm) are taken from the obtained steel sheet, and cyclic corrosion testing (also known as CCT) is performed under the following conditions with one face thereof as the testing face. Following the test, the specimens are immersed in concentrated nitric acid of 60° C. to remove rust, the number of points of rust on the test face is counted visually, and averaged between the two specimens, thereby evaluating the corrosion resistance of the steel sheets. Nine or less rust spots means corrosion resistance with no problems for practical use.

Corrosion Testing Conditions: Five Cycles of the Following Cycle;

- Misting with salt water (5% NaCl solution at 35° C.) for two hours,
- drying for four hours (60° C. and relative humidity of 30% or lower), and
- wetting for two hours (50° C. and relative humidity of 95%).

(4) Bending Test

Three specimens (size: t×25 mm wide×70 mm long) are taken from the obtained steel sheet such that the longitudinal direction is parallel to the rolling direction, subjected to 180° bending with an inner radius of 0.75 mm, 1.5 mm, 2.0 mm, and 3.0 mm, following which the outer side of the bend is observed with a magnifying glass to inspect of cracks, and the minimum bending inner radius (mm) with no cracking occurring is obtained. Smallest bending inner radius of less than t (e.g., less than 3.0 mm in the event that t=3.0) means bending workability sufficient for practical use.

(5) Weld-Heat-Affected Zone Toughness Test

Two specimens (size: t×150 mm wide×300 mm long) are taken from the obtained steel sheet for fabricating joints, abutted with each other so that the faces of the sheets in the thickness direction thereof parallel in the rolling direction face one another, and welded together so as to form a welded joint by MIG welding. The conditions for MIG welding here are JIS Y308 for the wire, electric current of 150 A, voltage of 19V, welding speed of 9 mm/s, shielding gas of Argon 100 percent by volume at a flow of 20 1/min, and root gap of 1 mm.

Figure 3:
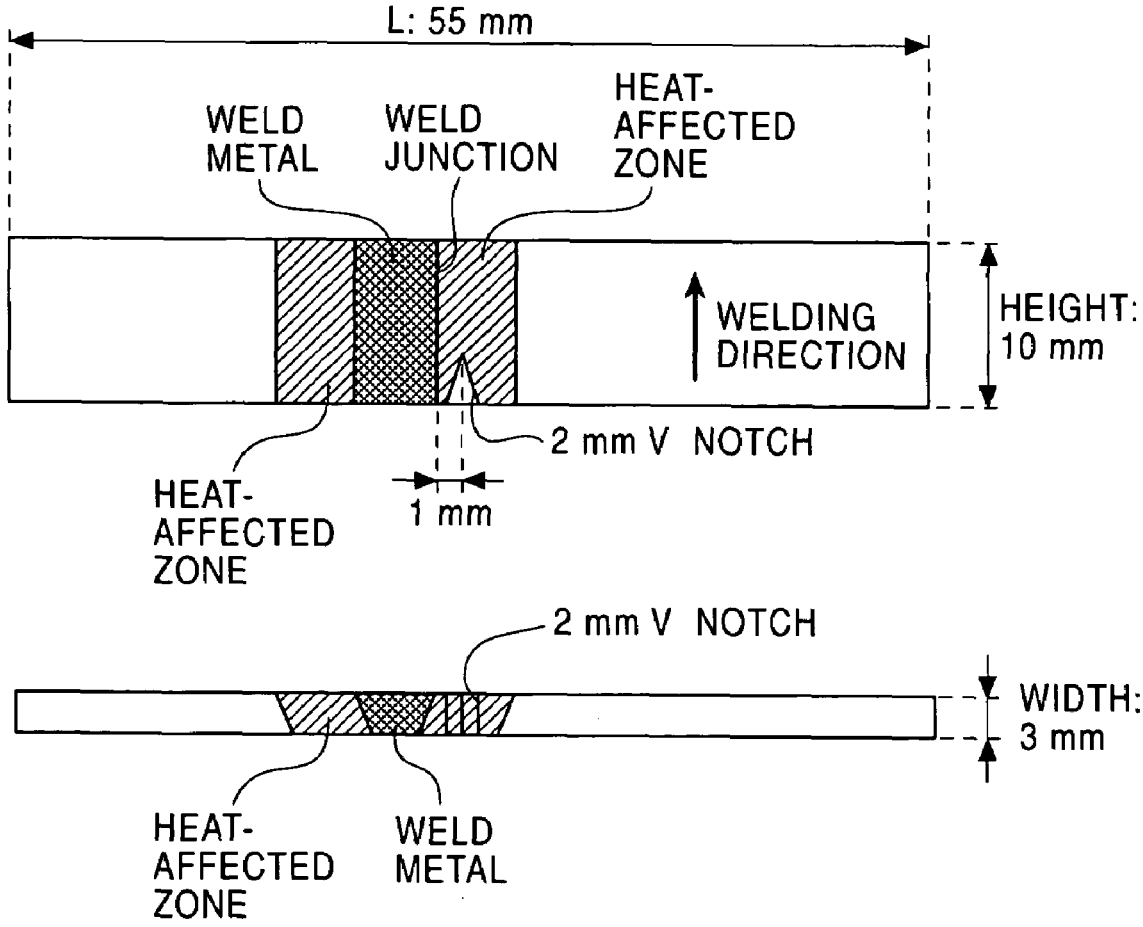
FIG. 3 is an explanatory diagram schematically illustrating a notch position of a weld-heat-affected zone toughness test piece.

Five JIS Z 2202 No. 4 sub-size Charpy impact testing specimens (size: 10 mm thick×t wide×55 mm long) are obtained from the obtained welded joint by machining such that the longitudinal direction of the specimens is parallel to the width direction of the steel sheet. A notch is formed at a heat-affected zone 1 mm from the binding portion, as shown in FIG. 3. Testing is performed conforming to the stipulations of JIS Z 2242 at −50° C., the absorption energy is calculated, and the weld-heat-affected zone toughness is evaluated from a value $vE_{-50}$ (J/cm$^2$) obtained by dividing the absorption energy value by the original section area of the notch base. The average of the five specimens is taken as the value for the steel sheet. A $vE_{-50}$ of 40 J/cm$^2$ or more means that the weld-heat-affected zone toughness is sufficient for practical use.

The results of the tests are shown in Table 3 and Table 4. Each of the examples according to the present invention have high tensile strength of 730 MPa or higher, excellent corrosion resistance, and excellent bending workability and weld-heat-affected zone toughness. On the other hand, with the comparative examples which are outside the range of the present invention, either the tensile strength is less than 730 MPa, corrosion resistance is deteriorated, bending workability is deteriorated, or weld-heat-affected zone toughness is deteriorated.

Example 2

The properties of cold-rolled steel sheets are inspected. A hot-rolled steel sheet 3 mm in thickness, of the steel No. 1K in Table 1 from the Example 1 is subjected to annealing of being held at 700° C. for 10 hours and then gradually cooled, and descaled with acid wash. The hot-rolled annealed sheet is rolled with a reverse mill by cold rolling to a thickness of 1.5 mm, subjected to finishing heat treatment of being held at 1000° C. for 30 seconds, and then cooled to a cooling-stop temperature of 100° C. at a rate of 15° C./s, and descaled by immersion in a 60° C. mixed acid (10% by mass of nitric acid+3% by mass of hydrofluoric acid), thereby obtaining a cold-rolled steel sheet with a thickness t of 1.5 mm. The same tests as the hot-rolled steel sheet in Example 1 are performed in this example.

The only difference is that the welding for testing weld zone toughness is TIG welding (electric current of 95 A, voltage of 11 v, welding speed of 400 mm/min, and flow of shield gas of 20 liters/min for front (electrode) side and 10 liters/min for rear side. The results show that the martensite percentage by volume was 73%, CCT rust count is zero, smallest inner bending radius is 0.75 mm (½ t, i.e., half of the sheet thickness t). Tensile strength is 975 MPa, and breaking elongation is 10%. Weld-heat-affected zone toughness show the Charpy impact testing value ($vE_{-50}$) at −50° C. to be 70 J/cm$^2$. Thus, it is confirmed that cold-rolled steel sheets have approximately the same properties as hot-rolled steel sheets.

Example 3

Finishing heat treatment with a batch annealing furnace under the conditions shown in Table 7 and Table 8 is performed on stainless cold-rolled steel sheets of the composition shown in Table 5 and Table 6, and washed with acid. The obtained steel sheet having thickness t of 0.7 mm is subjected to the (1) metal structure observation, (2), tensile test, and (3) corrosion test, as with the Example 1. The cold-rolled steel sheet used as the material is manufactured by heating a 100 kgf ingot of steel of the composition shown in Table 5 and Table 6 molten in a high-frequency furnace to 1200° C., finished to 3 mm thickness by hot rolling with a reverse mill, subjected to annealing of being held at 700° C. for 10 hours and then gradually cooled, descaled with acid washing, and then the hot-rolled annealed sheet is rolled by cold-rolling with a reverse mill to a thickness of 0.7 mm.

Figure 2:
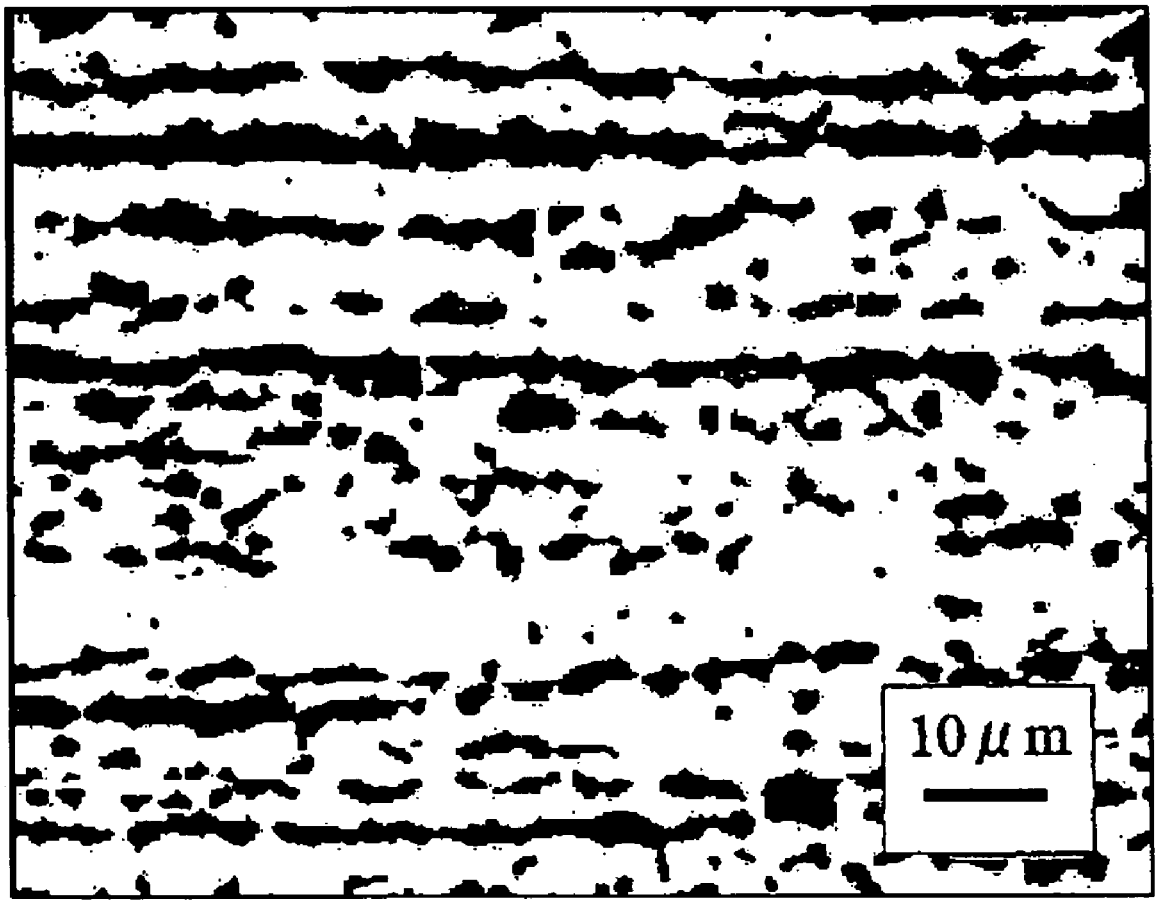
FIG. 2 is a photograph of the structure of a steel plate (No. 2-1) taken with an optical microscope.

FIG. 2 shows a structure photograph taken with an optical microscope of the steel sheet No. 2-1 (Table 7), as an example of the (1) metal structure observation results. The black portions are the ferrite structure, and white portions are the martensite structure. The volume percentage of martensite structure in this view is 73%.

The results are shown in Table 7 and Table 8.

Figure 4:
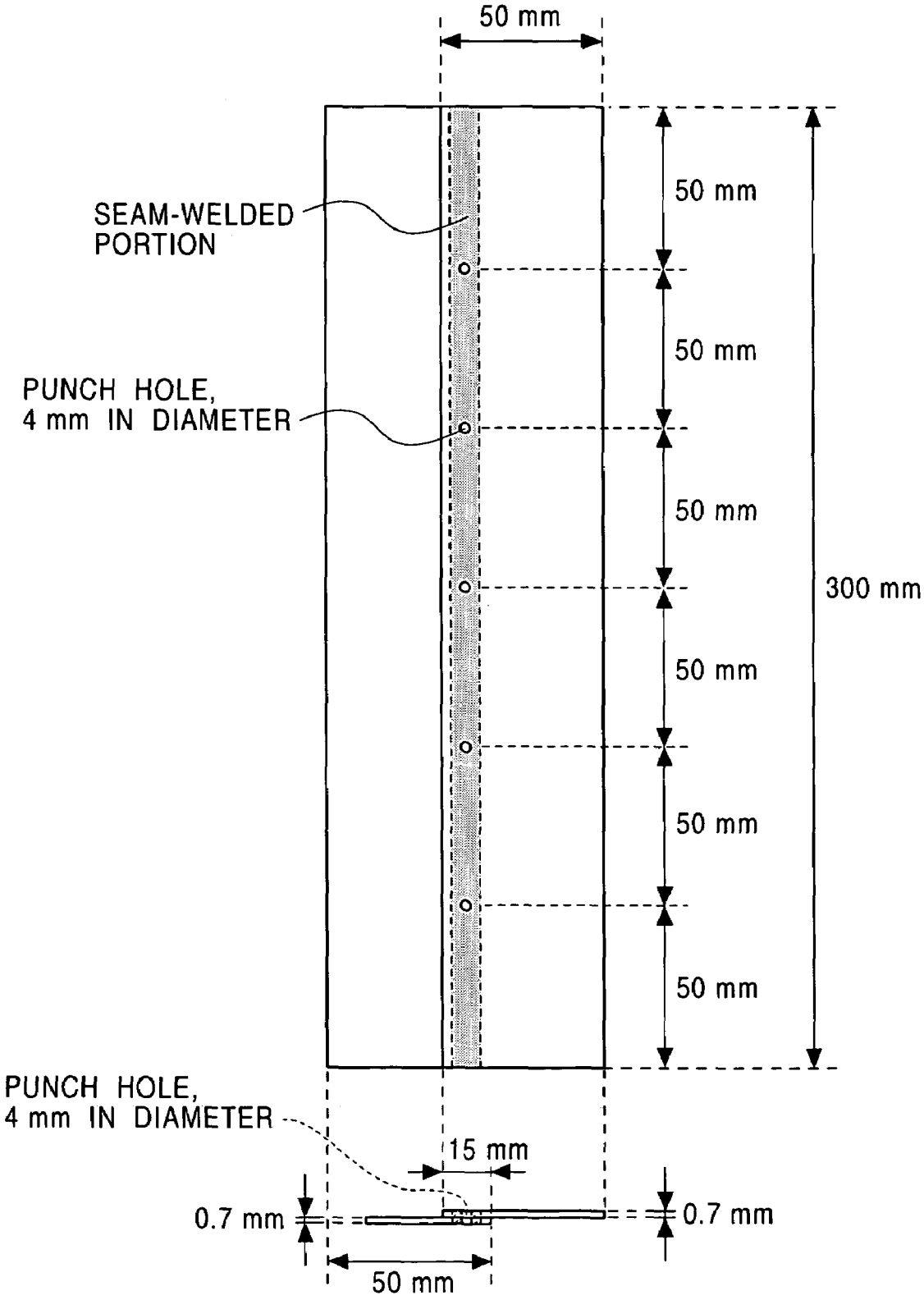
FIG. 4 is an explanatory diagram schematically illustrating a punch working test piece for a seam weld zone.
Figure 5A:
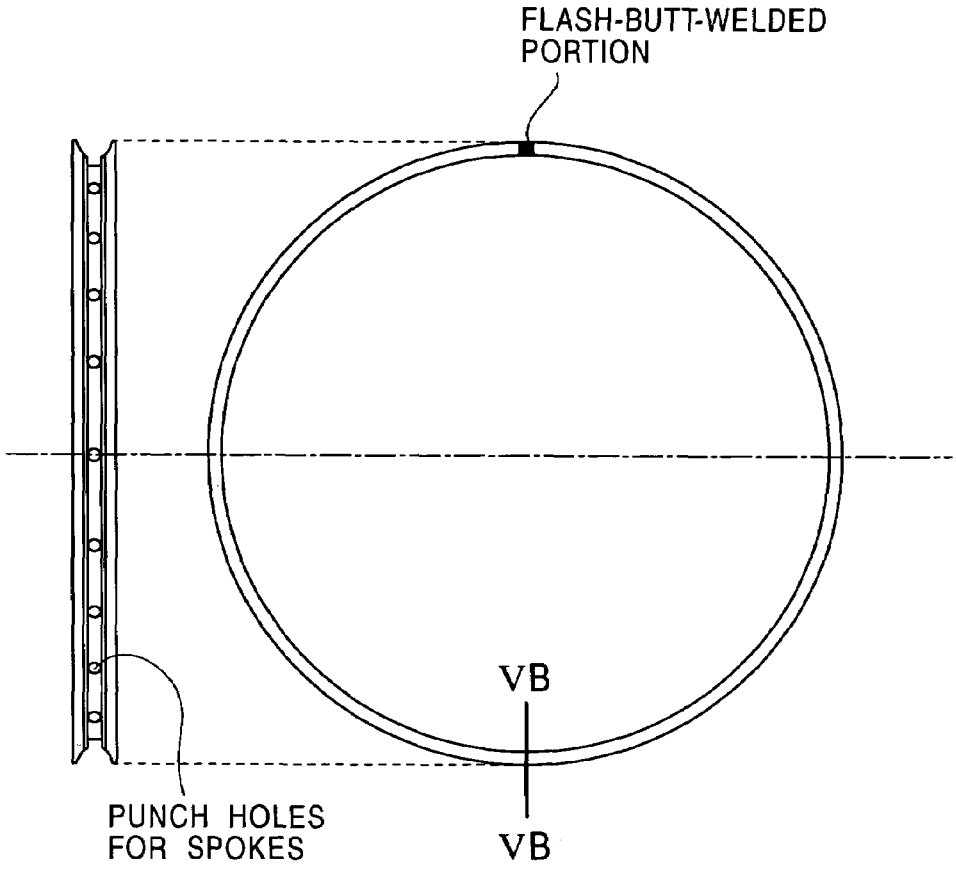
FIGS. 5A through 5C are diagrams illustrating a bicycle rim and the cross-sectional shape thereof.
Figure 5B:
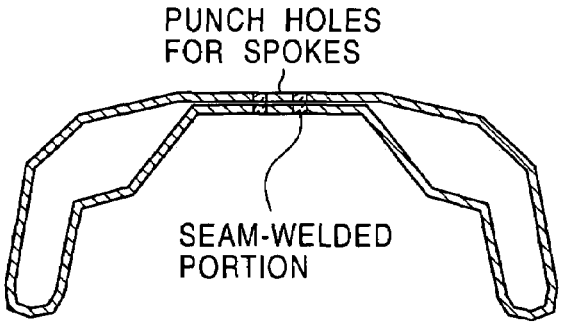
Figure 5C:
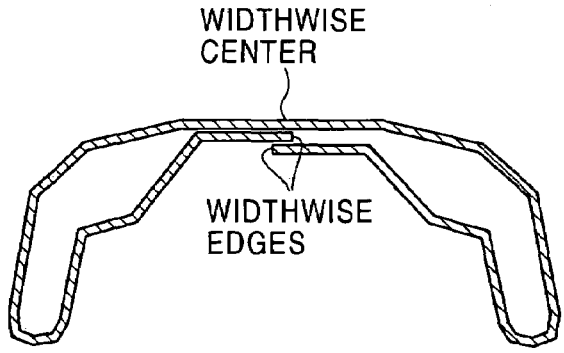

Further, two seam weld zone punching workability specimens shown in FIG. 4, assuming a bicycle rim such as shown in FIGS. 5A through 5C, each t×50 mm wide×300 mm long are taken from the obtained cold-rolled steel sheet, the two were overlaid, and subjected to seam welding in the lengthwise direction with an automatic seam welder, under welding conditions of electrode width of 6 mm, welding speed of 120 cm/min, application pressure of 3 kN, and welding electric current of 8 kA. Five holes, 4 mm in diameter are punched at 50 mm intervals from the edge of the obtained welded piece along the middle, assuming bicycle spoke holes. After punching, cracks are inspected for around all holes at a magnification of 10 times with a magnifying glass. Also, the specimens following breaking observation are then subjected to corrosion testing in the same may as with (3), and whether or not rust at the hole portions (punch shearing faces) was observed by eye. While this seam weld tone punching workability test is specifically performed with application to steel sheets for bicycle rims in mind as shown in FIG. 5, application may be made to other usages in the same manner.

The obtained results are also given in Table 7 and Table 8.

Each of the examples of the present invention satisfying the suitable range for applications requiring corrosion resistance and weld zone punching workability, application to wheels for example, have high tensile strength of 800 MPa or higher, excellent corrosion resistance, no cracks are observed in punching of the weld zones, and the hole faces of the punch holes have excellent corrosion resistance. On the other hand, examples of the present invention outside of the suitable range (indicated by being in brackets [ ]) for applications requiring corrosion resistance and weld zone punching workability, application to wheels for example, either have a tensile strength of less than 800 MPa, exhibit some deterioration in punching workability of the weld zones, or exhibit some deterioration in the corrosion resistance of the punch hole portions.

Example 4

The properties of hot-rolled steel sheets are also inspected. The hot-rolled steel No. A in Table 5 from Example 3 is subjected to finishing heat treatment of being held at 1000° C. for 30 seconds and then cooled to a cooling stop temperature of 100° C. at a rate of 30° C./s, and descaled by immersion in a 60° C. mixed acid (15% by mass of nitric acid+5% by mass of hydrofluoric acid), thereby obtaining a hot-rolled steel sheet with a thickness t of 2.0 mm.

The hot-rolled steel sheet used as the material is manufactured by heating a 100 kgf ingot of steel of the steel No. A composition, shown in Table 3, molten in a high-frequency furnace to 1200° C., finished to 2.0 mm thickness by hot rolling with a reverse mill. The sheet is subjected to the same tests as the cold-rolled steel sheet in Example 3.

The obtained hot-rolled steel sheet is subjected to the (1) metal structure observation, (2), tensile test, and (3) corrosion test. Further, two seam weld zone punching workability specimens, each t×50 mm wide×300 mm long, are taken from the obtained hot-rolled steel sheet, the two are overlaid, and subjected to seam welding in the lengthwise direction with an automatic seam welder, under welding conditions of electrode width of 6 mm, welding speed of 100 cm/min, application pressure of 7 kN, and welding electric current of 12 kA. Five holes, 4 mm in diameter are punched at 50 mm intervals from the edge of the obtained welded piece along the middle, assuming bicycle spoke holes. After punching, cracks are inspected for around all holes at a magnification of 10 times using a magnifying glass. Also, the specimens following breaking observation are then subjected to corrosion testing in the same way as with (3), and whether or not rust at the hole portions (punch shearing faces) was observed by eye.

As a result, the volume percentage of martensite structure is 75%, and the CCT rust count is zero. Tensile strength is 920 MPa, and breaking elongation is 12%. No cracks are observed in punching of the weld zones, and the hole faces of the punch holes have excellent corrosion resistance. Hot-rolled steel sheets thus have approximately the same properties as cold-rolled steel sheets.

According to the present invention, high-strength stainless steel sheets with high tensile strength of 730 MPa or higher, and excellent corrosion resistance, bending workability, and weld zone toughness, and further high-strength stainless-steel sheets with excellent weld zone punching workability, can be provided easily and inexpensively, thus yielding marked industrial advantages. The high-strength stainless steel sheets according to the present invention can be applied to usages requiring corrosion resistance and weld zone punching workability, such as application to bicycle rims, unicycles, carts using spoke wheels, tricycles, wheelchairs, and the like.

TABLE 1

| STEEL | CHEMICAL COMPOSITION (% BY MASS) | | | | | | | | | | | | VALUE OF MIDDLE TERM IN EQUATIONS (1) AND | VALUE OF MIDDLE TERM IN EQUATIONS (2) AND | VALUE OF LEFT SIDE IN EQUATIONS (3) AND | VALUE OF MIDDLE TERM IN EQUATIONS (4) AND |
|---|---|---|---|---|---|---|---|---|---|---|---|---|---|---|---|---|
| NO. | C | Si | Mn | P | S | Cr | Ni | Mo | Al | N | B | Cu | (5)* | (6)** | (7)*** | (8)**** |
| 1 | 0.0077 | 0.22 | 0.23 | 0.023 | 0.004 | 14.8 | 2.43 | — | 0.003 | 0.0088 | — | — | 15.1 | 3.0 | 16.0 | 0.0165 |
| 2 | 0.0128 | 0.23 | 0.25 | 0.022 | 0.003 | 15.9 | 0.62 | — | 0.005 | 0.0025 | — | — | 16.2 | 1.2 | 16.2 | 0.0153 |
| 3 | 0.0078 | 0.33 | 0.32 | 0.020 | 0.003 | 14.6 | 2.89 | — | 0.005 | 0.0065 | — | — | 15.1 | 3.5 | 16.0 | 0.0143 |
| 4 | 0.0089 | 0.23 | 1.74 | 0.023 | 0.004 | 15.2 | 1.85 | — | 0.011 | 0.0058 | — | — | 15.5 | 3.2 | 16.1 | 0.0147 |
| 5 | 0.0079 | 0.19 | 0.36 | 0.021 | 0.005 | 16.3 | 1.83 | — | 0.005 | 0.0069 | — | — | 16.6 | 2.5 | 17.2 | 0.0148 |
| 1A | 0.0066 | 0.25 | 0.28 | 0.022 | 0.003 | 10.8 | 1.68 | 1.45 | 0.005 | 0.0088 | 0.0012 | — | 12.6 | 2.3 | 16.4 | 0.0154 |
| 1B | 0.0168 | 0.23 | 0.38 | 0.022 | 0.003 | 13.1 | 1.86 | 1.15 | 0.003 | 0.0022 | 0.0025 | 0.10 | 14.6 | 2.7 | 17.9 | 0.0190 |
| 1C | 0.0085 | 0.25 | 0.32 | 0.021 | 0.004 | 13.4 | 2.33 | 0.43 | 0.005 | 0.0066 | 0.0035 | — | 14.2 | 2.9 | 16.0 | 0.0151 |
| 1D | 0.0078 | 0.23 | 0.24 | 0.021 | 0.003 | 13.4 | 2.41 | 0.41 | 0.004 | 0.0055 | 0.0033 | 0.33 | 14.2 | 3.1 | 16.1 | 0.0133 |
| 1E | 0.0088 | 0.12 | 0.35 | 0.021 | 0.002 | 16.3 | 1.88 | — | 0.005 | 0.0061 | 0.0034 | — | 16.5 | 2.5 | 17.2 | 0.0149 |
| 1F | 0.0075 | 0.56 | 1.61 | 0.021 | 0.003 | 13.2 | 0.65 | 0.66 | 0.008 | 0.0085 | 0.0005 | 1.22 | 14.7 | 2.5 | 16.3 | 0.0160 |
| 1G | 0.0085 | 0.24 | 0.31 | 0.022 | 0.003 | 13.3 | 1.98 | 1.09 | 0.003 | 0.0055 | — | — | 14.8 | 2.6 | 17.9 | 0.0140 |
| 1H | 0.0064 | 0.21 | 0.25 | 0.021 | 0.004 | 13.4 | 2.75 | 1.04 | 0.005 | 0.0053 | 0.0018 | — | 14.8 | 3.2 | 18.2 | 0.0117 |
| 1I | 0.0041 | 0.28 | 0.22 | 0.025 | 0.002 | 13.2 | 1.88 | 1.21 | 0.005 | 0.0143 | 0.0031 | 0.06 | 14.8 | 2.6 | 18.2 | 0.0184 |
| 1J | 0.0091 | 0.15 | 0.16 | 0.021 | 0.003 | 13.3 | 1.45 | 0.56 | 0.063 | 0.0052 | 0.0048 | 1.88 | 14.1 | 2.9 | 16.8 | 0.0143 |
| 1K | 0.0061 | 0.23 | 0.22 | 0.021 | 0.003 | 13.2 | 2.11 | 1.06 | 0.003 | 0.0087 | 0.0025 | — | 14.6 | 2.7 | 17.8 | 0.0148 |
| 1L | 0.0086 | 0.18 | 0.24 | 0.024 | 0.003 | 14.2 | 2.13 | — | 0.003 | 0.0092 | 0.0021 | 1.53 | 14.5 | 3.5 | 16.0 | 0.0178 |
| 1M | 0.0059 | 0.21 | 0.19 | 0.022 | 0.002 | 15.2 | 2.22 | — | 0.005 | 0.0098 | 0.0022 | — | 15.5 | 2.8 | 16.3 | 0.0157 |
| 1N | 0.0055 | 0.09 | 0.21 | 0.021 | 0.004 | 13.4 | 1.94 | 1.07 | 0.008 | 0.0021 | 0.0025 | — | 14.6 | 2.3 | 17.9 | 0.0076 |
| 1O | 0.0142 | 0.18 | 0.26 | 0.021 | 0.002 | 13.2 | 2.03 | 1.10 | 0.008 | 0.0105 | 0.0023 | — | 14.6 | 2.9 | 17.8 | 0.0247 |
| 1P | 0.0082 | 0.08 | 0.12 | 0.021 | 0.003 | 13.2 | 0.88 | 0.89 | 0.005 | 0.0045 | 0.0028 | — | 14.2 | 1.3 | 16.6 | 0.0127 |
| 1Q | 0.0253 | 0.25 | 0.23 | 0.023 | 0.003 | 13.2 | 2.03 | 1.18 | 0.003 | 0.0044 | 0.0029 | — | 14.8 | 3.0 | 18.1 | 0.0297 |
| 1R | 0.0045 | 0.16 | 0.29 | 0.022 | 0.003 | 13.4 | 0.54 | 0.45 | 0.003 | 0.0097 | — | 2.27 | 14.1 | 2.2 | 16.3 | 0.0142 |
| 1S | 0.0078 | 0.85 | 0.33 | 0.021 | 0.003 | 10.2 | 1.55 | 1.52 | 0.004 | 0.0096 | 0.0027 | — | 13.0 | 2.2 | 16.0 | 0.0174 |

*MIDDLE TERM IN EQUATIONS (1) AND (5): Cr + Mo + 1.5 Si

**MIDDLE TERM IN EQUATIONS (2) AND (6): Ni + 30(C + N) + 0.5(Mn + Cu)

***LEFT SIDE IN EQUATIONS (3) AND (7): Cr + 0.5(Ni + Cu) + 3.3 Mo

****MIDDLE TERM IN EQUATIONS (4) AND (8): C + N

TABLE 2

| STEEL NO. | CHEMICAL COMPOSITION (% BY MASS) C | Si | Mn | P | S | Cr | Ni | Mo | Al | N | B | Cu | VALUE OF MIDDLE TERM IN EQUATIONS (1) AND (5)* | VALUE OF MIDDLE TERM IN EQUATIONS (2) AND (6)** | VALUE OF LEFT SIDE IN EQUATIONS (3) AND (7)*** | VALUE OF MIDDLE TERM IN EQUATIONS (4) AND (8)**** |
|---|---|---|---|---|---|---|---|---|---|---|---|---|---|---|---|---|
| 1T | 0.0089 | 0.18 | 0.31 | 0.020 | 0.002 | 13.1 | 0.43 | 1.21 | 0.003 | 0.0112 | 0.0022 | 1.23 | 14.6 | 1.8 | 17.9 | 0.0201 |
| 1U | 0.0046 | 0.15 | 0.12 | 0.018 | 0.002 | 13.2 | 3.23 | 1.08 | 0.003 | 0.0055 | 0.0022 | — | 14.5 | 3.6 | 18.4 | 0.0101 |
| 1V | 0.0092 | 0.22 | 0.35 | 0.018 | 0.002 | 13.1 | 2.11 | 1.03 | 0.153 | 0.0078 | — | — | 14.5 | 2.8 | 17.6 | 0.0170 |
| 1W | 0.0035 | 0.18 | 0.22 | 0.021 | 0.003 | 13.3 | 1.97 | 1.20 | 0.040 | 0.0252 | 0.0025 | — | 14.8 | 2.9 | 18.2 | 0.0287 |
| 1X | 0.0075 | 0.18 | 1.78 | 0.021 | 0.003 | 13.4 | 2.45 | 1.15 | 0.003 | 0.0077 | 0.0033 | 1.31 | 14.8 | 4.5 | 19.1 | 0.0152 |
| 1Y | 0.0165 | 0.19 | 0.13 | 0.022 | 0.003 | 13.3 | 1.56 | 1.06 | 0.003 | 0.0146 | 0.0025 | — | 14.6 | 2.6 | 17.6 | 0.0311 |
| 1Z | 0.0093 | 0.22 | 0.34 | 0.022 | 0.003 | 14.8 | 1.38 | — | 0.003 | 0.0085 | 0.0057 | 1.88 | 15.1 | 3.0 | 16.4 | 0.0178 |
| 2A | 0.0078 | 0.22 | 0.32 | 0.022 | 0.003 | 13.0 | 1.82 | 0.53 | 0.003 | 0.0096 | 0.0023 | — | 13.9 | 2.5 | 15.7 | 0.0174 |
| 2B | 0.0023 | 0.16 | 0.23 | 0.021 | 0.002 | 13.4 | 1.88 | 1.05 | 0.003 | 0.0029 | 0.0021 | 0.33 | 14.7 | 2.3 | 18.0 | 0.0052 |
| 2C | 0.0081 | 0.52 | 0.23 | 0.021 | 0.004 | 14.8 | 2.28 | 1.99 | 0.013 | 0.0081 | 0.0024 | — | 17.6 | 2.9 | 22.5 | 0.0162 |
| 2D | 0.0048 | 0.15 | 0.08 | 0.021 | 0.003 | 13.0 | 0.12 | 1.04 | 0.003 | 0.0043 | 0.0029 | — | 14.3 | 0.4 | 16.5 | 0.0091 |
| 2E | 0.0049 | 0.08 | 0.24 | 0.021 | 0.003 | 11.3 | 2.38 | — | 0.003 | 0.0051 | 0.0019 | 1.90 | 11.4 | 3.8 | 13.4 | 0.0100 |
| 2F | 0.0081 | 0.22 | 0.31 | 0.021 | 0.003 | 12.1 | 2.08 | 2.28 | 0.004 | 0.0075 | — | — | 14.7 | 2.7 | 20.7 | 0.0156 |
| 2G | 0.0064 | 0.12 | 0.23 | 0.020 | 0.003 | 17.8 | 2.66 | — | 0.003 | 0.0081 | 0.0019 | — | 18.0 | 3.2 | 19.1 | 0.0145 |

*MIDDLE TERM IN EQUATIONS (1) AND (5): Cr + Mo + 1.5 Si
**MIDDLE TERM IN EQUATIONS (2) AND (6): Ni + 30(C + N) + 0.5(Mn + Cu)
***LEFT SIDE IN EQUATIONS (3) AND (7): Cr + 0.5(Ni + Cu) + 3.3 Mo
****MIDDLE TERM IN EQUATIONS (4) AND (8): C + N

TABLE 3

| STEEL SHEET NO. | STEEL NO. | CONFORMATION TO EQUATIONS (1) THROUGH (4) (1) | (2) | (3) | (4) | FINISHING HEAT TREATMENT CONDITIONS HEATING TEMPERATURE (° C.) | HOLDING TIME (s) | COOLING RATE (° C./s) | COOL-TO TEMPERATURE (° C.) | STRUCTURE TYPE* | MARTENSITE (% BY VOLUME) |
|---|---|---|---|---|---|---|---|---|---|---|---|
| 1 | 1 | ○ | ○ | ○ | ○ | 1000 | 30 | 15 | 100 | α + M | 82 |
| 2 | 2 | ○ | ○ | ○ | ○ | 950 | 30 | 15 | 100 | α + M | 16 |
| 3 | 3 | ○ | ○ | ○ | ○ | 1000 | 60 | 30 | 100 | α + M | 95 |
| 4 | 4 | ○ | ○ | ○ | ○ | 1050 | 30 | 15 | 100 | α + M | 81 |
| 5 | 5 | ○ | ○ | ○ | ○ | 1000 | 20 | 15 | 100 | α + M | 50 |
| 6 | 1A | ○ | ○ | ○ | ○ | 1000 | 30 | 15 | 100 | α + M | 84 |
| 7 | 1B | ○ | ○ | ○ | ○ | 1000 | 30 | 15 | 100 | α + M | 75 |
| 8 | 1C | ○ | ○ | ○ | ○ | 1000 | 30 | 15 | 100 | α + M | 80 |
| 9 | 1D | ○ | ○ | ○ | ○ | 1000 | 30 | 15 | 100 | α + M | 83 |
| 10 | 1E | ○ | ○ | ○ | ○ | 1000 | 30 | 15 | 100 | α + M | 22 |
| 11 | 1F | ○ | ○ | ○ | ○ | 1000 | 30 | 15 | 100 | α + M | 51 |
| 12 | 1G | ○ | ○ | ○ | ○ | 1000 | 30 | 3 | 100 | α + M | 18 |
| 13 | 1H | ○ | ○ | ○ | ○ | 1000 | 30 | 15 | 100 | α + M | 82 |
| 14 | 1I | ○ | ○ | ○ | ○ | 1000 | 30 | 15 | 100 | α + M | 70 |
| 15 | 1J | ○ | ○ | ○ | ○ | 1000 | 30 | 15 | 100 | α + M | 80 |
| 16 | 1K | ○ | ○ | ○ | ○ | 1000 | 30 | 15 | 100 | α + M | 76 |
| 17 | | | | | | 820 | 30 | 15 | 100 | α + M | 10 |
| 18 | | | | | | 1280 | 30 | 15 | 100 | α + M | 7 |
| 19 | | | | | | 1000 | 5 | 15 | 100 | α + M | 65 |
| 20 | | | | | | 1000 | 30 | 0.3 | 100 | α + M | 9 |
| 21 | | | | | | 1000 | 30 | 15 | 200 | α + M | 75 |
| 22 | | | | | | 900 | 30 | 15 | 100 | α + M | 70 |
| 23 | | | | | | 1150 | 30 | 15 | 100 | α + M | 72 |
| 24 | 1L | ○ | ○ | ○ | ○ | 1000 | 30 | 15 | 100 | α + M | 85 |
| 25 | 1M | ○ | ○ | ○ | ○ | 1000 | 30 | 15 | 100 | α + M | 48 |

| STEEL SHEET NO. | TENSILE PROPERTIES TENSILE STRENGTH (MPa) | ELONGATION (%) | CORROSION RESISTANCE CCT RUST COUNT (NUMBER) | BENDING WORKABILITY MINIMUM BENDING INNER RADIUS (mm) | TOUGHNESS OF HEAT-AFFECTED ZONES vE−50 (J/cm$^2$) | REFERENCE |
|---|---|---|---|---|---|---|
| 1 | 1132 | 10 | 3 | 2.0 | 59 | EX. |
| 2 | 774 | 15 | 3 | 2.0 | 48 | EX. |

TABLE 3-continued

| | | | | | | |
|---|---|---|---|---|---|---|
| 3 | 1187 | 10 | 3 | 2.0 | 78 | EX. |
| 4 | 1091 | 9 | 5 | 2.0 | 95 | EX. |
| 5 | 904 | 13 | 0 | 2.0 | 40 | EX. |
| 6 | 1031 | 10 | 3 | 2.0 | 130 | EX. |
| 7 | 959 | 9 | 0 | 2.0 | 56 | EX. |
| 8 | 1098 | 10 | 3 | 1.5 | 92 | EX. |
| 9 | 1115 | 10 | 3 | 1.5 | 94 | EX. |
| 10 | 785 | 14 | 1 | 2.0 | 60 | EX. |
| 11 | 825 | 10 | 3 | 2.0 | 45 | EX. |
| 12 | 755 | 15 | 0 | 1.5 | 81 | EX. |
| 13 | 1037 | 10 | 0 | 1.5 | 124 | EX. |
| 14 | 931 | 11 | 0 | 1.5 | 89 | EX. |
| 15 | 980 | 9 | 1 | 2.0 | 82 | EX. |
| 16 | 968 | 12 | 0 | 1.5 | 87 | EX. |
| 17 | 687 | 15 | 0 | 1.5 | 78 | C. EX. |
| 18 | 708 | 15 | 0 | 1.5 | 71 | C. EX. |
| 19 | 815 | 13 | 0 | 1.5 | 85 | EX. |
| 20 | 715 | 15 | 0 | 1.5 | 74 | C. EX. |
| 21 | 958 | 12 | 0 | 1.5 | 85 | EX. |
| 22 | 955 | 12 | 0 | 1.5 | 88 | EX. |
| 23 | 961 | 12 | 0 | 1.5 | 86 | EX. |
| 24 | 1189 | 9 | 3 | 2.0 | 87 | EX. |
| 25 | 905 | 10 | 3 | 2.0 | 72 | EX. |

*α: FERRITE, M: MARTENSITE
"EX.: EXAMPLE ACCORDING TO PRESENT INVENTION
C. EX.: COMPARATIVE EXAMPLE"

TABLE 4

| STEEL SHEET NO. | STEEL NO. | CONFORMATION TO EQUATIONS (1) THROUGH (4) (1) | (2) | (3) | (4) | FINISHING HEAT TREATMENT CONDITIONS HEATING TEMPERATURE (° C.) | HOLDING TIME (s) | COOLING RATE (° C./s) | COOL-TO TEMPERATURE (° C.) | STRUCTURE TYPE* | MARTENSITE (% BY VOLUME) |
|---|---|---|---|---|---|---|---|---|---|---|---|
| 26 | 1N | ○ | ○ | ○ | ○ | 1000 | 30 | 5 | 100 | α + M | 64 |
| 27 | 1O | ○ | ○ | ○ | ○ | 1000 | 30 | 15 | 100 | α + M | 83 |
| 28 | 1P | ○ | ○ | ○ | ○ | 1000 | 30 | 15 | 100 | α + M | 40 |
| 29 | 1Q | ○ | ○ | ○ | ○ | 1000 | 30 | 15 | 100 | α + M | 84 |
| 30 | 1R | ○ | ○ | ○ | ○ | 1000 | 30 | 15 | 100 | α + M | 68 |
| 31 | 1S | ○ | ○ | ○ | ○ | 1000 | 30 | 15 | 100 | α + M | 79 |
| 32 | 1T | ○ | ○ | ○ | ○ | 1000 | 30 | 15 | 100 | α + M | 7 |
| 33 | 1U | ○ | ○ | ○ | ○ | 1000 | 30 | 15 | 100 | M | 100 |
| 34 | 1V | ○ | ○ | ○ | ○ | 1000 | 30 | 15 | 100 | α + M | 81 |
| 35 | 1W | ○ | ○ | ○ | ○ | 1000 | 30 | 15 | 100 | α + M | 80 |
| 36 | 1X | ○ | x | ○ | ○ | 1000 | 30 | 15 | 100 | M | 100 |
| 37 | 1Y | ○ | ○ | ○ | x | 1000 | 30 | 15 | 100 | α + M | 72 |
| 38 | 1Z | ○ | ○ | ○ | ○ | 1000 | 30 | 15 | 100 | α + M | 81 |
| 39 | 2A | ○ | ○ | x | ○ | 1000 | 30 | 15 | 100 | α + M | 78 |
| 40 | 2B | ○ | ○ | ○ | x | 1000 | 30 | 15 | 100 | α + M | 45 |
| 41 | 2C | x | ○ | ○ | ○ | 1000 | 30 | 15 | 100 | α + M | 7 |
| 42 | 2D | ○ | x | ○ | ○ | 1000 | 30 | 15 | 100 | α + M | 6 |
| 43 | 2E | x | ○ | x | ○ | 1000 | 30 | 15 | 100 | M | 100 |
| 44 | 2F | ○ | ○ | ○ | ○ | 1000 | 30 | 15 | 100 | α + M | 56 |
| 45 | 2G | x | ○ | ○ | ○ | 1000 | 30 | 15 | 100 | α + M | 10 |

| STEEL SHEET NO. | TENSILE PROPERTIES TENSILE STRENGTH (MPa) | ELONGATION (%) | CORROSION RESISTANCE CCT RUST COUNT (NUMBER) | BENDING WORKABILITY MINIMUM BENDING INNER RADIUS (mm) | TOUGHNESS OF HEAT-AFFECTED ZONES vE−50 (J/cm$^2$) | REFERENCE |
|---|---|---|---|---|---|---|
| 26 | 915 | 11 | 0 | 1.5 | 77 | EX. |
| 27 | 989 | 10 | 0 | 2.0 | 56 | EX. |
| 28 | 888 | 11 | 2 | 1.5 | 45 | EX. |
| 29 | 1139 | 5 | 0 | >3.0 | 11 | C. EX. |
| 30 | 926 | 6 | 3 | >3.0 | 58 | C. EX. |
| 31 | 959 | 11 | 12 | 1.5 | 46 | C. EX. |
| 32 | 696 | 15 | 0 | 1.5 | 14 | C. EX. |
| 33 | 1240 | 4 | 0 | >3.0 | 85 | C. EX. |
| 34 | 932 | 5 | 10 | 3.0 | 54 | C. EX. |

TABLE 4-continued

| | | | | | | |
|---|---|---|---|---|---|---|
| 35 | 1027 | 10 | 0 | >3.0 | 58 | C. EX. |
| 36 | 1077 | 9 | 0 | >3.0 | 135 | C. EX. |
| 37 | 1202 | 7 | 1 | >3.0 | 18 | C. EX. |
| 38 | 993 | 11 | 10 | 2.0 | 78 | C. EX. |
| 39 | 989 | 11 | 12 | 1.5 | 93 | C. EX. |
| 40 | 719 | 14 | 0 | 1.5 | 84 | C. EX. |
| 41 | 646 | 22 | 0 | 2.0 | 41 | C. EX. |
| 42 | 649 | 22 | 2 | 1.5 | 15 | C. EX. |
| 43 | 1236 | 7 | 15 | >3.0 | 131 | C. EX. |
| 44 | 928 | 7 | 0 | 3.0 | 56 | C. EX. |
| 45 | 716 | 11 | 0 | 3.0 | 15 | C. EX. |

*α: FERRITE, M: MARTENSITE
"EX.: EXAMPLE ACCORDING TO PRESENT INVENTION
C. EX.: COMPARATIVE EXAMPLE"

TABLE 5

| STEEL | CHEMICAL COMPOSITION (% BY MASS) | | | | | | | | | | | | VALUE OF MIDDLE TERM IN EQUATIONS (1) | VALUE OF MIDDLE TERM IN EQUATIONS (2) AND | VALUE OF LEFT SIDE IN EQUATIONS (3) AND | VALUE OF MIDDLE TERM IN EQUATIONS (4) AND |
|---|---|---|---|---|---|---|---|---|---|---|---|---|---|---|---|---|
| NO. | C | Si | Mn | P | S | Cr | Ni | Mo | Al | N | B | Cu | AND (5)* | (6)** | (7)*** | (8)**** |
| A | 0.0065 | 0.11 | 0.16 | 0.024 | 0.002 | 13.3 | 2.02 | 1.01 | 0.030 | 0.0075 | 0.0015 | — | 14.5 | 2.5 | 17.6 | 0.014 |
| B | 0.0084 | 0.10 | 0.16 | 0.024 | 0.002 | 13.3 | 2.03 | 0.98 | 0.008 | 0.0085 | 0.0018 | — | 14.4 | 2.6 | 17.5 | 0.017 |
| C | 0.0052 | 0.10 | 0.16 | 0.024 | 0.002 | 13.3 | 2.01 | 0.99 | 0.007 | 0.0053 | 0.0025 | — | 14.4 | 2.4 | 17.6 | 0.011 |
| D | 0.0055 | 0.07 | 0.11 | 0.027 | 0.002 | 13.5 | 1.94 | 1.07 | 0.012 | 0.0066 | 0.0022 | — | 14.7 | 2.4 | 18.0 | 0.012 |
| E | 0.0085 | 0.08 | 0.21 | 0.026 | 0.001 | 13.5 | 2.21 | 1.10 | 0.010 | 0.0095 | 0.0013 | — | 14.7 | 2.9 | 18.2 | 0.018 |
| F | 0.0085 | 0.09 | 0.11 | 0.025 | 0.002 | 13.2 | 1.67 | 0.89 | 0.009 | 0.0045 | 0.0021 | — | 14.2 | 2.1 | 17.0 | 0.013 |
| G | 0.0059 | 0.07 | 0.11 | 0.024 | 0.002 | 13.1 | 1.92 | 0.89 | 0.013 | 0.0075 | 0.0028 | — | 14.1 | 2.4 | 17.0 | 0.013 |
| H | 0.0062 | 0.81 | 0.33 | 0.024 | 0.003 | 11.4 | 1.64 | 1.52 | 0.025 | 0.0070 | 0.0015 | — | 14.1 | 2.2 | 17.2 | 0.013 |
| I | 0.0165 | 0.25 | 0.18 | 0.022 | 0.003 | 12.8 | 1.85 | 1.13 | 0.023 | 0.0032 | 0.0022 | — | 14.3 | 2.5 | 17.5 | 0.020 |
| J | 0.0082 | 0.13 | 0.34 | 0.025 | 0.005 | 13.8 | 1.81 | 0.55 | 0.011 | 0.0075 | 0.0025 | — | 14.5 | 2.5 | 16.5 | 0.016 |
| K | 0.0098 | 0.08 | 0.42 | 0.026 | 0.002 | 14.3 | 1.91 | 0.58 | 0.018 | 0.0051 | 0.0024 | — | 15.0 | 2.6 | 17.2 | 0.015 |
| L | 0.0082 | 0.11 | 1.58 | 0.022 | 0.003 | 13.2 | 0.75 | 1.22 | 0.028 | 0.0085 | 0.0018 | — | 14.6 | 2.0 | 17.6 | 0.017 |
| M | 0.0080 | 0.14 | 0.43 | 0.024 | 0.003 | 13.2 | 1.85 | 1.15 | 0.003 | 0.0050 | 0.0005 | — | 14.6 | 2.5 | 17.9 | 0.013 |
| N | 0.0044 | 0.11 | 0.13 | 0.021 | 0.005 | 13.4 | 2.65 | 1.04 | 0.015 | 0.0063 | 0.0028 | — | 14.6 | 3.0 | 18.2 | 0.011 |
| O | 0.0021 | 0.25 | 0.36 | 0.029 | 0.003 | 13.1 | 1.92 | 1.11 | 0.033 | 0.0175 | 0.0021 | — | 14.6 | 2.7 | 17.7 | 0.020 |
| P | 0.0089 | 0.11 | 0.36 | 0.024 | 0.003 | 13.1 | 1.89 | 1.13 | 0.002 | 0.0042 | 0.0049 | — | 14.4 | 2.5 | 17.8 | 0.013 |
| Q | 0.0211 | 0.16 | 0.13 | 0.023 | 0.003 | 13.2 | 2.15 | 1.18 | 0.005 | 0.0036 | 0.0023 | — | 14.6 | 3.0 | 18.2 | 0.025 |
| R | 0.0065 | 0.26 | 0.28 | 0.023 | 0.003 | 13.7 | 1.81 | 0.43 | 0.003 | 0.0097 | 0.0025 | — | 14.5 | 2.4 | 16.0 | 0.016 |
| S | 0.0073 | 0.82 | 0.31 | 0.024 | 0.002 | 10.8 | 1.52 | 1.94 | 0.010 | 0.0096 | 0.0024 | — | 14.0 | 2.2 | 18.0 | 0.017 |
| T | 0.0085 | 0.23 | 1.87 | 0.020 | 0.002 | 12.8 | 0.44 | 1.17 | 0.003 | 0.0112 | 0.0029 | — | 14.3 | 2.0 | 16.9 | 0.020 |
| U | 0.0045 | 0.11 | 0.11 | 0.019 | 0.002 | 13.2 | 3.16 | 1.13 | 0.005 | 0.0057 | 0.0027 | — | 14.5 | 3.5 | 18.5 | 0.010 |

*MIDDLE TERM IN EQUATIONS (1) AND (5): Cr + Mo + 1.5 Si
**MIDDLE TERM IN EQUATIONS (2) AND (6): Ni + 30(C + N) + 0.5(Mn + Cu)
***LEFT SIDE IN EQUATIONS (3) AND (7): Cr + 0.5(Ni + Cu) + 3.3 Mo
****MIDDLE TERM IN EQUATIONS (4) AND (8): C + N

TABLE 6

| STEEL | CHEMICAL COMPOSITION (% BY MASS) | | | | | | | | | | | | VALUE OF MIDDLE TERM IN EQUATIONS (1) | VALUE OF MIDDLE TERM IN EQUATIONS (2) AND | VALUE OF LEFT SIDE IN EQUATIONS (3) AND | VALUE OF MIDDLE TERM IN EQUATIONS (4) AND |
|---|---|---|---|---|---|---|---|---|---|---|---|---|---|---|---|---|
| NO. | C | Si | Mn | P | S | Cr | Ni | Mo | Al | N | B | Cu | AND (5)* | (6)** | (7)*** | (8)**** |
| V | 0.0096 | 0.19 | 0.34 | 0.017 | 0.002 | 13.1 | 2.03 | 1.03 | 0.115 | 0.0073 | 0.0022 | — | 14.4 | 2.7 | 17.5 | 0.017 |
| W | 0.0033 | 0.16 | 0.21 | 0.022 | 0.002 | 13.3 | 1.94 | 1.10 | 0.046 | 0.022 | 0.0023 | — | 14.6 | 2.8 | 17.9 | 0.025 |
| X | 0.0079 | 0.14 | 0.19 | 0.022 | 0.005 | 13.2 | 1.85 | 1.15 | 0.003 | 0.0079 | 0.0003 | — | 14.6 | 2.4 | 17.9 | 0.016 |
| Y | 0.0135 | 0.21 | 0.23 | 0.023 | 0.003 | 13.2 | 2.02 | 1.05 | 0.003 | 0.0126 | 0.0018 | — | 14.6 | 2.9 | 17.7 | 0.0261 |
| Z | 0.0091 | 0.12 | 0.24 | 0.024 | 0.002 | 13.2 | 1.88 | 1.15 | 0.005 | 0.0081 | 0.0058 | — | 14.5 | 2.5 | 17.9 | 0.017 |
| AA | 0.0089 | 0.24 | 0.14 | 0.021 | 0.003 | 13.1 | 1.91 | 1.05 | 0.003 | 0.0081 | 0.0023 | 0.05 | 14.5 | 2.5 | 17.5 | 0.017 |
| BA | 0.0076 | 0.48 | 0.22 | 0.029 | 0.002 | 13.0 | 1.82 | 0.57 | 0.002 | 0.0098 | 0.0028 | — | 14.3 | 2.5 | 15.8 | 0.017 |
| CA | 0.0046 | 0.15 | 0.18 | 0.021 | 0.002 | 13.1 | 2.19 | 1.05 | 0.005 | 0.0048 | 0.0019 | — | 14.4 | 2.6 | 17.7 | 0.009 |
| DA | 0.0078 | 0.22 | 0.42 | 0.029 | 0.003 | 13.8 | 1.28 | 1.19 | 0.033 | 0.0081 | 0.0014 | — | 15.3 | 2.0 | 18.4 | 0.016 |

TABLE 6-continued

| STEEL NO. | CHEMICAL COMPOSITION (% BY MASS) C | Si | Mn | P | S | Cr | Ni | Mo | Al | N | B | Cu | VALUE OF MIDDLE TERM IN EQUATIONS (1) AND (5)* | VALUE OF MIDDLE TERM IN EQUATIONS (2) AND (6)** | VALUE OF LEFT SIDE IN EQUATIONS (3) AND (7)*** | VALUE OF MIDDLE TERM IN EQUATIONS (4) AND (8)**** |
|---|---|---|---|---|---|---|---|---|---|---|---|---|---|---|---|---|
| EA | 0.0048 | 0.25 | 0.11 | 0.021 | 0.005 | 13.2 | 1.52 | 1.15 | 0.005 | 0.0063 | 0.0021 | — | 14.7 | 1.9 | 17.8 | 0.011 |
| FA | 0.0089 | 0.18 | 0.24 | 0.024 | 0.002 | 12.4 | 1.98 | 1.24 | 0.004 | 0.0081 | 0.0029 | — | 13.9 | 2.6 | 17.5 | 0.017 |
| GA | 0.0078 | 0.18 | 0.28 | 0.021 | 0.003 | 12.1 | 2.08 | 2.25 | 0.016 | 0.0072 | 0.0025 | — | 14.6 | 2.7 | 20.6 | 0.015 |
| HA | 0.0044 | 0.08 | 0.13 | 0.020 | 0.002 | 15.3 | 1.66 | 0.55 | 0.005 | 0.0079 | 0.0019 | — | 16.0 | 2.1 | 17.9 | 0.012 |

*MIDDLE TERM IN EQUATIONS (1) AND (5): Cr + Mo + 1.5 Si
**MIDDLE TERM IN EQUATIONS (2) AND (6): Ni + 30(C + N) + 0.5(Mn + Cu)
***LEFT SIDE IN EQUATIONS (3) AND (7): Cr + 0.5(Ni + Cu) + 3.3 Mo
****MIDDLE TERM IN EQUATIONS (4) AND (8): C + N

TABLE 7

| STEEL SHEET NO. | STEEL NO. | CONFORMATION TO EQUATIONS (1) THROUGH (8) (1) | (2) | (3) | (4) | (5) | (6) | (7) | (8) | FINISHING HEAT TREATMENT CONDITIONS HEATING TEMPERATURE (° C.) | HOLDING TIME (h) | COOLING RATE (° C./s) | COOL-TO TEMPERATURE (° C.) | STRUCTURE TYPE* | MARTENSITE (% BY VOLUME) |
|---|---|---|---|---|---|---|---|---|---|---|---|---|---|---|---|
| 2-1 | A | ○ | ○ | ○ | ○ | ○ | ○ | ○ | ○ | 1000 | 30 | 30 | 100 | α + M | 73 |
| 2-2 | | | | | | | | | | 850 | 30 | 30 | 100 | α + M | 18 |
| 2-3 | | | | | | | | | | 1250 | 30 | 30 | 100 | α + M | 12 |
| 2-4 | | | | | | | | | | 1000 | 15 | 30 | 100 | α + M | 50 |
| 2-5 | | | | | | | | | | 1000 | 30 | 3 | 100 | α + M | 18 |
| 2-6 | | | | | | | | | | 1000 | 30 | 30 | 200 | α + M | 68 |
| 2-7 | | | | | | | | | | 900 | 30 | 30 | 100 | α + M | 70 |
| 2-8 | | | | | | | | | | 1150 | 30 | 30 | 100 | α + M | 70 |
| 2-9 | B | ○ | ○ | ○ | ○ | ○ | ○ | ○ | ○ | 1000 | 30 | 5 | 100 | α + M | 68 |
| 2-10 | C | ○ | ○ | ○ | ○ | ○ | ○ | ○ | ○ | 1000 | 30 | 30 | 100 | α + M | 69 |
| 2-11 | D | ○ | ○ | ○ | ○ | ○ | ○ | ○ | ○ | 1000 | 30 | 30 | 100 | α + M | 60 |
| 2-12 | E | ○ | ○ | ○ | ○ | ○ | ○ | ○ | ○ | 1000 | 30 | 30 | 100 | α + M | 74 |
| 2-13 | F | ○ | ○ | ○ | ○ | ○ | ○ | ○ | ○ | 1000 | 30 | 30 | 100 | α + M | 67 |
| 2-14 | G | ○ | ○ | ○ | ○ | ○ | ○ | ○ | ○ | 1000 | 30 | 30 | 100 | α + M | 78 |
| 2-15 | H | ○ | ○ | ○ | ○ | ○ | ○ | ○ | ○ | 1000 | 30 | 30 | 100 | α + M | 72 |
| 2-16 | I | ○ | ○ | ○ | ○ | ○ | ○ | ○ | ○ | 1000 | 30 | 30 | 100 | α + M | 77 |
| 2-17 | J | ○ | ○ | ○ | ○ | ○ | ○ | ○ | ○ | 1000 | 30 | 15 | 100 | α + M | 57 |
| 2-18 | K | ○ | ○ | ○ | ○ | ○ | ○ | ○ | ○ | 1000 | 30 | 30 | 100 | α + M | 55 |
| 2-19 | L | ○ | ○ | ○ | ○ | ○ | ○ | ○ | ○ | 1000 | 30 | 30 | 100 | α + M | 57 |
| 2-20 | M | ○ | ○ | ○ | ○ | ○ | ○ | ○ | ○ | 1000 | 30 | 30 | 100 | α + M | 67 |
| 2-21 | N | ○ | ○ | ○ | ○ | ○ | ○ | ○ | ○ | 1000 | 30 | 30 | 100 | α + M | 83 |
| 2-22 | O | ○ | ○ | ○ | ○ | ○ | ○ | ○ | ○ | 1000 | 30 | 30 | 100 | α + M | 73 |
| 2-23 | P | ○ | ○ | ○ | ○ | ○ | ○ | ○ | ○ | 1000 | 30 | 30 | 100 | α + M | 72 |

| STEEL SHEET NO. | TENSILE PROPERTIES TENSILE STRENGTH (MPa) | ELONGATION (%) | CORROSION RESISTANCE CCT RUST COUNT (NUMBER) | WELD ZONE PUNCHING WORKABILITY CRACKING | WELD ZONE PUNCHING CORROSION RESISTANCE RUSTING | REFERENCE |
|---|---|---|---|---|---|---|
| 2-1 | 929 | 8.2 | 1 | NONE | NONE | EX. |
| 2-2 | 788 | 9.7 | 1 | NONE | NONE | [EX.] |
| 2-3 | 765 | 10.0 | 1 | NONE | NONE | [EX.] |
| 2-4 | 850 | 9.2 | 1 | NONE | NONE | EX. |
| 2-5 | 768 | 10.0 | 1 | NONE | NONE | [EX.] |
| 2-6 | 915 | 8.4 | 1 | NONE | NONE | EX. |
| 2-7 | 922 | 83.0 | 1 | NONE | NONE | EX. |
| 2-8 | 925 | 8.3 | 1 | NONE | NONE | EX. |
| 2-9 | 905 | 8.5 | 1 | NONE | NONE | EX. |
| 2-10 | 883 | 8.4 | 1 | NONE | NONE | EX. |
| 2-11 | 827 | 9.3 | 0 | NONE | NONE | EX. |
| 2-12 | 982 | 8.1 | 0 | NONE | NONE | EX. |
| 2-13 | 852 | 9.0 | 2 | NONE | NONE | EX. |
| 2-14 | 944 | 8.0 | 2 | NONE | NONE | EX. |
| 2-15 | 929 | 8.4 | 3 | NONE | NONE | EX. |
| 2-16 | 962 | 7.5 | 1 | NONE | NONE | EX. |
| 2-17 | 834 | 9.0 | 3 | NONE | NONE | EX. |

TABLE 7-continued

| | | | | | | |
|---|---|---|---|---|---|---|
| 2-18 | 833 | 9.1 | 1 | NONE | NONE | EX. |
| 2-19 | 822 | 7.8 | 3 | NONE | NONE | EX. |
| 2-20 | 915 | 8.5 | 0 | NONE | NONE | EX. |
| 2-21 | 1038 | 7.5 | 0 | NONE | NONE | EX. |
| 2-22 | 980 | 7.5 | 1 | NONE | NONE | EX. |
| 2-23 | 968 | 8.0 | 2 | NONE | NONE | EX. |

*α: FERRITE, M: MARTENSITE

[EX.]: UNSATISFACTORY FOR APPLICATION TO USAGES WHEREIN CORROSION RESISTANCE AND PUNCHING WORKABILITY OF WELD ZONES

"EX.: EXAMPLE ACCORDING TO PRESENT INVENTION

C. EX.: COMPARATIVE EXAMPLE"

TABLE 8

| STEEL SHEET NO. | STEEL NO. | CONFORMATION TO EQUATIONS (1) THROUGH (8) | | | | | | | | FINISHING HEAT TREATMENT CONDITIONS | | | | STRUCTURE | |
|---|---|---|---|---|---|---|---|---|---|---|---|---|---|---|---|
| | | (1) | (2) | (3) | (4) | (5) | (6) | (7) | (8) | HEATING TEMPERATURE (° C.) | HOLDING TIME (h) | COOLING RATE (° C./s) | COOL-TO TEMPERATURE (° C.) | TYPE* | MARTENSITE (% BY VOLUME) |
| 2-24 | Q | ○ | ○ | ○ | ○ | ○ | ○ | ○ | x | 1000 | 30 | 30 | 100 | α + M | 80 |
| 2-25 | R | ○ | ○ | ○ | ○ | ○ | ○ | ○ | ○ | 1000 | 30 | 30 | 100 | α + M | 67 |
| 2-26 | S | ○ | ○ | ○ | ○ | ○ | ○ | ○ | ○ | 1000 | 30 | 30 | 100 | α + M | 76 |
| 2-27 | T | ○ | ○ | ○ | ○ | ○ | ○ | ○ | ○ | 1000 | 30 | 30 | 100 | α + M | 28 |
| 2-28 | U | ○ | ○ | ○ | ○ | ○ | x | ○ | ○ | 1000 | 30 | 30 | 100 | M | 100 |
| 2-29 | V | ○ | ○ | ○ | ○ | ○ | ○ | ○ | ○ | 1000 | 30 | 30 | 100 | α + M | 79 |
| 2-30 | W | ○ | ○ | ○ | ○ | ○ | ○ | ○ | x | 1000 | 30 | 30 | 100 | α + M | 75 |
| 2-31 | x | ○ | ○ | ○ | ○ | ○ | ○ | ○ | ○ | 1000 | 30 | 30 | 100 | α + M | 66 |
| 2-32 | Y | ○ | ○ | ○ | ○ | ○ | ○ | ○ | x | 1000 | 30 | 30 | 100 | α + M | 81 |
| 2-33 | Z | ○ | ○ | ○ | ○ | ○ | ○ | ○ | ○ | 1000 | 30 | 30 | 100 | α + M | 70 |
| 2-34 | AA | ○ | ○ | ○ | ○ | ○ | ○ | ○ | ○ | 1000 | 30 | 30 | 100 | α + M | 89 |
| 2-35 | BA | ○ | ○ | x | ○ | ○ | ○ | x | ○ | 1000 | 30 | 30 | 100 | α + M | 75 |
| 2-36 | CA | ○ | ○ | ○ | ○ | ○ | ○ | ○ | x | 1000 | 30 | 30 | 100 | α + M | 76 |
| 2-37 | DA | ○ | ○ | ○ | ○ | x | ○ | ○ | ○ | 1000 | 30 | 30 | 100 | α + M | 18 |
| 2-38 | EA | ○ | ○ | ○ | ○ | ○ | x | ○ | ○ | 1000 | 30 | 30 | 100 | α + M | 12 |
| 2-39 | FA | ○ | ○ | ○ | ○ | x | ○ | ○ | ○ | 1000 | 30 | 30 | 100 | α + M | 95 |
| 2-40 | GA | ○ | ○ | ○ | ○ | ○ | ○ | ○ | ○ | 1000 | 30 | 30 | 100 | α + M | 72 |
| 2-41 | HA | ○ | ○ | ○ | ○ | x | ○ | ○ | ○ | 1000 | 30 | 30 | 100 | α + M | 14 |

| STEEL SHEET NO. | TENSILE PROPERTIES: TENSILE STRENGTH (MPa) | TENSILE PROPERTIES: ELONGATION (%) | CORROSION RESISTANCE: CCT RUST COUNT (NUMBER) | WELD ZONE: PUNCHING WORKABILITY CRACKING | WELD ZONE PUNCHING: CORROSION RESISTANCE RUSTING | REFERENCE |
|---|---|---|---|---|---|---|
| 2-24 | 1171 | 3.8 | 0 | OBSERVED | NONE | [EX.] |
| 2-25 | 928 | 8.2 | 9 | NONE | OBSERVED | [EX.] |
| 2-26 | 957 | 8.0 | 8 | NONE | OBSERVED | [EX.] |
| 2-27 | 757 | 7.5 | 7 | NONE | OBSERVED | C. EX. |
| 2-28 | 1125 | 3.5 | 0 | OBSERVED | NONE | C. EX. |
| 2-29 | 1023 | 4.6 | 6 | OBSERVED | NONE | [EX.] |
| 2-30 | 1047 | 4.8 | 1 | OBSERVED | NONE | [EX.] |
| 2-31 | 863 | 7.3 | 1 | OBSERVED | NONE | [EX.] |
| 2-32 | 1035 | 4.5 | 1 | OBSERVED | NONE | [EX.] |
| 2-33 | 984 | 8.0 | 7 | NONE | OBSERVED | C. EX. |
| 2-34 | 1078 | 4.1 | 1 | OBSERVED | NONE | [EX.] |
| 2-35 | 905 | 8.5 | 10 | NONE | OBSERVED | C. EX. |
| 2-36 | 788 | 9.6 | 1 | NONE | NONE | [EX.] |
| 2-37 | 755 | 9.5 | 0 | NONE | NONE | [EX.] |
| 2-38 | 730 | 9.7 | 1 | NONE | NONE | [EX.] |
| 2-39 | 1057 | 4.6 | 1 | OBSERVED | NONE | [EX.] |
| 2-40 | 1043 | 4.9 | 0 | OBSERVED | NONE | C. EX. |
| 2-41 | 748 | 6.8 | 0 | OBSERVED | NONE | [EX.] |

*α: FERRITE, M: MARTENSITE

[EX.]: UNSATISFACTORY FOR APPLICATION TO USAGES WHEREIN CORROSION RESISTANCE AND PUNCHING WORKABILITY OF WELD ZONES

"EX.: EXAMPLE ACCORDING TO PRESENT INVENTION

C. EX.: COMPARATIVE EXAMPLE"

What is claimed is:

1. A high-strength stainless steel material in the form of a wheel rim consisting essentially of:

a composition including less than 0.1% by mass of Cu, 0.1% by mass or more but less than 2.0% by mass of Mo, 0.0005% to 0.0050% by mass of B, 0.02% by mass or less of C, 1.0% by mass or less of Si, 2.0% by mass or less of Mn, 0.04% by mass or less of P, 0.01% by mass or less of S, 0.1% by mass or less of Al, 11% by mass or more but less than 17% by mass of Cr, 0.5% by mass or more but less than 3.0% by mass of Ni, and 0.02% by mass or less of N, so as to satisfy the following equations (1) through (4), $$12 \leqq Cr+Mo+1.5\ Si \leqq 17 \quad (1)$$

$$1 \leqq Ni+30(C+N)+0.5(Mn+Cu) \leqq 4 \quad (2)$$

$$Cr+0.5(Ni+Cu)+3.3\ Mo \geqq 16.0 \quad (3)$$

$$0.006 \leqq C+N \leqq 0.030 \quad (4)$$

wherein, the contents of C, B, N, Si, Mn, Cr, Mo, Ni and Cu are in % by mass, and the remainder essentially consisting of Fe;

a structure including 12 to 95% by volume of martensite, and the remainder essentially consisting of ferrite, a tensile strength equal to or greater than 730 Mpa, and a weld-heat-affected zone toughness at −50° C. equal to or greater than 40 J/cm$^2$ wherein the wheel rim is incorporated into a wheel.

2. The high-strength stainless steel wheel rim according to claim 1, wherein said composition further comprises:

0.5% by mass or more but less than 2.0% by mass of Mo, with the range of C, Al, Cr, and N, being further restricted to 0.020% by mass or less of C, 0.10% by mass or less of Al, 11.0% by mass or more but less than 15.0% by mass of Cr, and 0.020% by mass or less of N, and with said equations (1) through (4) being replaced by the following equations (5) through (8), $$14.0 \leqq Cr+Mo+1.5Si \leqq 15.0 \quad (5)$$

$$2.0 \leqq Ni+30(C+N)+0.5(Mn+Cu) \leqq 3.0 \quad (6)$$

$$Cr+0.5(Ni+Cu)+3.3\ Mo \geqq 16.0 \quad (7)$$

$$0.010 \leqq C+N \leqq 0.02 \quad (8)$$

wherein, the contents of C, N, Si, Mn, Cr, Mo, Ni and Cu are in % by mass, and wherein said structure includes 20% by volume or more of martensite, and the remainder essentially consisting of ferrite;

and wherein the composition of said high-strength stainless steel wheel rim is designed for excellent corrosion resistance and punching workability of weld zones.

3. The high-strength stainless steel wheel rim according to claim 2, containing less than 0.04% by mass of Cu.

4. The high-strength stainless steel wheel rim according to claim 2, wherein said wheel rim is used with a wheel of one of bicycles, unicycles, carts using spoke wheels, tricycles, and wheelchairs.

5. A manufacturing method for a high-strength stainless steel wheel rim comprising:

providing a composition consisting essentially of:

less than 0.1% by mass of Cu, 0.1% by mass or more but less than 2.0% by mass of Mo, 0.0005% to 0.0050% by mass of B, 0.02% by mass or less of C, 1.0% by mass or less of Si, 2.0% by mass or less of Mn, 0.04% by mass or less of P, 0.01% by mass or less of S, 0.1% by mass or less of Al, 11% by mass or more but less than 17% by mass of Cr, 0.5% by mass or more but less than 3.0% by mass of Ni, and 0.02% by mass or less of N, so as to satisfy the following Expressions (1) through (4), $$12 \leqq Cr+Mo+1.5Si \leqq 17 \quad (1)$$

$$1 \leqq Ni+30(C+N)+0.5(Mn+Cu) \leqq 4 \quad (2)$$

$$Cr+0.5(Ni+Cu)+3.3\ Mo \leqq 16.0 \quad (3)$$

$$0.006 \leqq C+N \leqq 0.030 \quad (4)$$

wherein, the contents of C, B, N, Si, Mn, Cr, Mo, Ni and Cu are in % by mass, the tensile strength of the stainless steel sheet is equal to or greater than 730 Mpa, and a weld-heat-affected zone toughness at −50° C. is equal to or greater than 40 J/cm$^2$, subjecting the composition to a finishing heat treatment of being heated to a temperature within a range of 850° C. to 1250° C., cooling the composition at a cooling rate of 1° C./s or faster, and forming the composition into a rim for a wheel.

6. The manufacturing method for a high-strength stainless steel wheel rim according to claim 5, wherein said composition further comprises:

0.5% by mass or more but less than 2.0% by mass of Mo, with the range of C, Al, Cr, and N, being further restricted to 0.020% by mass or less of C, 0.10% by mass or less of Al, 11.0% by mass or more but less than 15.0% by mass of Cr, and 0.020% by mass or less of N, and with said Expressions (1) through (4) being replaced by the following Expressions (5) through (8), $$14.0 \leqq Cr+Mo+1.5\ Si \leqq 15.0 \quad (5)$$

$$2.0 \leqq Ni+30(C+N)+0.5(Mn+Cu) \leqq 3.0 \quad (6)$$

$$Cr+0.5\ NI+3.3\ Mo \geqq 16.0 \quad (7)$$

$$0.010 \leqq C+N \leqq 0.02 \quad (8)$$

wherein, the contents of C, N, Si, Mn, Cr, Mo, Ni and Cu are in % by mass, wherein said material is subjected to finishing heat treatment of being heated to a temperature within a range of 900 to 1200° C. and then cooled at a cooling rate of 5° C./s or faster, and wherein the composition is designed for excellent corrosion resistance and punching workability of weld zones.

7. The manufacturing method for a high-strength stainless steel wheel rim according to claim 6, said composition containing less than 0.04% by mass of Cu.

8. The manufacturing method for a high-strength stainless steel wheel rim according to claim 6, wherein said wheel rim is used with a wheel of one of bicycles, unicycles, carts using spoke wheels, tricycles, and wheelchairs.

9. The manufacturing method for a high-strength stainless steel wheel rim according to claim 5, further comprising:

hot-rolling the composition before forming into the wheel rim.

10. The manufacturing method for a high-strength stainless steel wheel rim according to claim 5, further comprising:

cold-rolling the composition before forming into the wheel rim.

11. The high-strength stainless steel wheel rim according to claim 3, wherein said high-strength stainless steel wheel rim is used with a wheel of one of bicycles, unicycles, carts using spoke wheels, tricycles, and wheelchairs.

12. The manufacturing method a high-strength stainless steel wheel rim according to claim 7, wherein said high-strength stainless steel wheel rim is used with a wheel for one of bicycles, unicycles, carts using spoke wheels, tricycles, and wheelchairs.

* * * * *